US005998081A

United States Patent [19]

Morrison et al.

[11] Patent Number: 5,998,081

[45] Date of Patent: Dec. 7, 1999

[54] DEVELOPMENT PROCESSES

[75] Inventors: Ian D. Morrison, Webster, N.Y.; John F. Oliver, Mississauga, Canada; James R. Larson, Fairport, N.Y.; Edward Anczurowski, Oakville, Canada; Anthony M. Wallace, Rochester, N.Y.

[73] Assignee: Xerox Corporation, Stamford, Conn.

[21] Appl. No.: 07/986,316

[22] Filed: Dec. 4, 1992

[51] Int. Cl.[6] ..... G03G 15/10

[52] U.S. Cl. ..... 430/117; 430/118

[58] Field of Search ..... 430/118, 98, 124, 430/117

[56] References Cited

U.S. PATENT DOCUMENTS

| | | | |
|---|---|---|---|
| 3,795,530 | 3/1974 | Gundlach | 430/118 |
| 3,907,694 | 9/1975 | Lu | 252/62.1 |
| 4,130,670 | 12/1978 | Gilliams et al. | 427/16 |
| 4,137,340 | 1/1979 | Verlinden et al. | 427/16 |
| 4,557,991 | 12/1985 | Takagiwa et al. | 430/109 |
| 4,659,640 | 4/1987 | Santilli | 430/119 |
| 4,842,974 | 6/1989 | Landa et al. | 430/137 |
| 5,229,235 | 7/1993 | Watanabe et al. | 430/124 |
| 5,232,812 | 8/1993 | Morrison et al. | 430/124 |

FOREIGN PATENT DOCUMENTS

| | | | |
|---|---|---|---|
| 0348844 | 1/1990 | European Pat. Off. | G03G 15/06 |
| 0382142 | 8/1990 | European Pat. Off. | G03G 13/22 |
| 0433012 | 6/1991 | European Pat. Off. | G03G 15/01 |
| 0433014 | 6/1991 | European Pat. Off. | G03G 15/10 |
| 0455343 | 6/1991 | European Pat. Off. | G03G 9/12 |

*Primary Examiner*—Christopher D. Rodee
*Attorney, Agent, or Firm*—Judith L. Byorick

[57] ABSTRACT

Disclosed is a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development. Specific processes disclosed include electrophoretic development processes, polarizable liquid development processes, and photoelectrophoretic development processes. Optionally, the developed image is transferred to a substrate subsequent to development.

30 Claims, 1 Drawing Sheet

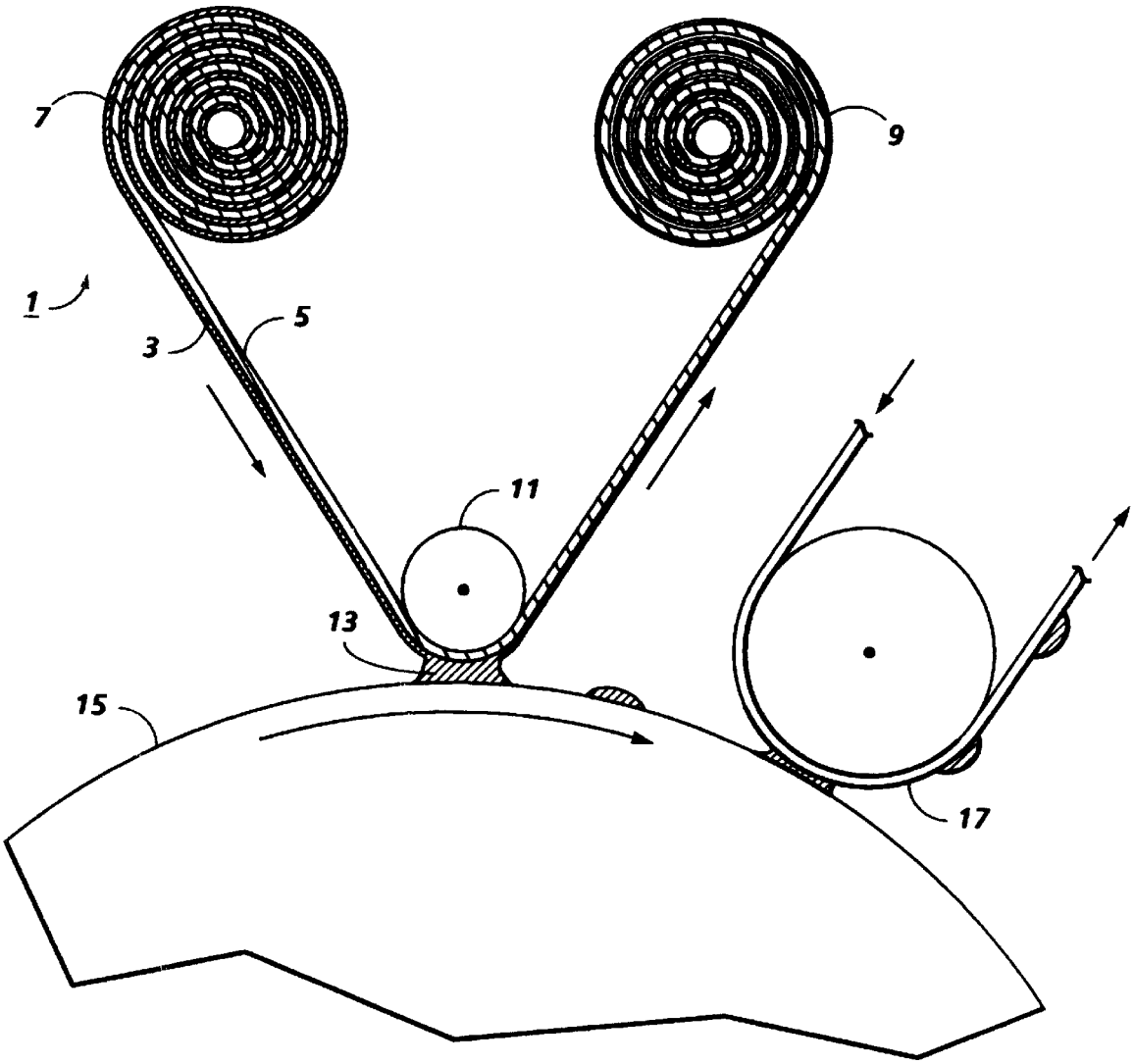
7
9
1
3
5
11
13
15
17

DEVELOPMENT PROCESSES

BACKGROUND OF THE INVENTION

The present invention is directed to compositions and processes for the development of electrostatic latent images. More specifically, the present invention is directed to compositions and processes for developing electrostatic latent images with liquid developers having a vehicle that is in liquid form under development conditions and in solid form subsequent to development. One embodiment of the present invention is directed to a process for forming images which comprises (a) generating an electrostatic latent image, (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image, and (c) cooling the developed image to a temperature below its melting point subsequent to development.

The formation and development of images on the surface of photoconductive materials by electrostatic means is well known. For example, U.S. Pat. No. 2,297,691 discloses an electrophotographic imaging process that entails placing a uniform electrostatic charge on a photoconductive insulating layer, such as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. When the toner is charged to a polarity opposite to that of the latent electrostatic image on the photoreceptor, the toner will normally be attracted to those areas of the photoreceptor which retain a charge, thereby forming a toner image corresponding to the electrostatic latent image. When the toner is charged to the same polarity as that of the charge applied to the photoreceptor, the toner will normally be attracted to those areas which have been discharged; this process is known as discharge area development. This developed image may then be transferred to a substrate such as paper and subsequently be permanently affixed to the substrate.

In ionographic imaging processes, a latent image is formed on a dielectric image receptor or electroreceptor by ion deposition, as described, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, and 4,155,093, the disclosures of each of which are totally incorporated herein by reference. Generally, the process entails application of charge in an image pattern with an ionographic writing head to a dielectric receiver that retains the charged image. The image is subsequently developed with a developer capable of developing charge images.

For electrophotographic and ionographic processes, either dry or liquid developers may be used for development of the electrostatic latent image. Liquid electrophoretic developers generally comprise a liquid vehicle in which is dispersed charged colored toner particles. In liquid electrophotographic development processes, the photoreceptor bearing the electrostatic latent image is transported through a bath of the liquid developer. Contact with the charged areas of the photoreceptor causes the charged toner particles present in the liquid vehicle to migrate through the liquid to the charged areas of the photoreceptor to develop the latent image. Thereafter, the photoreceptor is withdrawn from the liquid developer bath with the charged pigment particles adhering to the electrostatic latent image in image configuration. If desired, the image may be treated to remove some of the liquid vehicle. The developed image is then transferred to a suitable substrate, such as paper or transparency material, and, optionally, may be fixed to the substrate by heat, pressure, a combination of heat and pressure, or other suitable fixing means such as solvent or overcoating treatment. A similar process is used to develop latent images formed on ionographic imaging members.

In addition, liquid electrophoretic development of electrostatic latent images on charged papers is known. In these processes, the electrostatic latent image, which is usually formulated on a single sheet of dielectric paper, is transported through a bath of the liquid developer. Contact with the liquid developer causes the charged toner particles present in the liquid developer to migrate through the liquid vehicle to the dielectric paper in the configuration of the latent image. Thereafter, the sheet is withdrawn from the liquid developer bath with the charged toner particles adhering to the electrostatic latent image in image configuration. The thin film of residual developer remaining on the surface of the sheet is then evaporated within a relatively short time period, usually less than 5 seconds. Subsequently, the marking pigment particles may optionally be fixed to the sheet by any suitable method.

Polarizable liquid developers can also be used to develop electrostatic latent images. In polarizable liquid development processes, as disclosed in U.S. Pat. No. 3,084,043, the disclosure of which is totally incorporated herein by reference, liquid developers having relatively low viscosity and low volatility and relatively high electrical conductivity (relatively low volume resistivity) are deposited on a gravure roller to fill the depressions in the roller surface. Excess developer is removed from the lands between the depressions, and as a receiving surface charged in image configuration passes near the gravure roller, liquid developer is attracted from the depressions onto the receiving surface in image configuration by the charged image. Developers and processes of this type are disclosed in, for example, U.S. Pat. Nos. 4,047,943, 4,059,444, 4,822,710, 4,804,601, 4,766,049, Canadian Patent 937,823, Canadian Patent 926, 182, Canadian Patent 942,554, British Patent 1,321,286, and British Patent 1,312,844, the disclosures of each of which are totally incorporated herein by reference.

In photoelectrophoretic liquid development processes, as disclosed in, for example, U.S. Pat. Nos. 4,135,925, 3,383, 993, 3,384,488, 3,384,565, 3,384,566, 4,043,655, and 4,023, 968, the disclosures of each of which are totally incorporated herein by reference, colored photosensitive toner particles are suspended in an insulating carrier liquid. The suspension is placed between at least two electrodes subjected to a potential difference and exposed to a light image. Typically, the imaging suspension is placed on a transparent electrically conductive support in the form of a thin film and exposure is made through the transparent support while a second biased electrode is rolled across the suspension. It is believed that the particles bear an initial charge once suspended in the liquid carrier which causes them to be attracted to the transparent base electrode upon application of the potential difference. Upon exposure, the particles change polarity by exchanging charge with the base electrode so that the exposed particles migrate to the second or roller electrode, thereby forming the images. Both polychromatic and monochromatic images can be formed by the process; when polychromatic images are prepared, the liquid developer can contain toner particles of more than one color.

Typically, liquid developers employ aliphatic saturated hydrocarbons as liquid vehicles, most commonly high boiling aliphatic hydrocarbons that are relatively high in resistivity and nontoxic. Developers and processes of this type are disclosed in, for example, U.S. Pat. Nos. 4,476,210, 2,877,133, 2,890,174, 2,899,335, 2,892,709, 2,913,353, 3,729,419, 3,841,893, 3,968,044, 4,794,651, 4,762,764, 4,830,945, 4,686,936, 4,766,049, 4,707,429, 4,780,388, 3,976,808, 4,877,698, 4,880,720, 4,880,432, and copending application U.S. Ser. No. 07/300,395, the disclosures of each of which are totally incorporated herein by reference.

U.S. Pat. No. 4,659,640 (Santilli) discloses a liquid electrographic developer containing a volatile, electrically insulating carrier liquid, polyester toner particles, and wax dispersed in the carrier. The wax-to-polyester weight ratio in the developer is sufficiently high to render the developer self-fixing at room temperature. Upon application of the developer to a latent image and evaporation of the liquid carrier from the image, the toner, aided by the wax at the indicated concentration level, is fixed to the surface without the need for externally applied heat.

U.S. Pat. No. 4,557,991 (Takagiwa et al.) discloses a toner for development of electrostatic images which comprises a wax comprising a polyolefin and a binder resin selected from the group consisting of a polyester resin, a vinyl polymer, a styrene-butadiene copolymer, a styrene polymer, a styrene-containing copolymer, and a polymer containing a reactive prepolymer.

U.S. Pat. No. 4,842,974 (Landa et al.) discloses a liquid composition for developing latent electrostatic images comprising toner particles associated with a pigment dispersed in a nonpolar liquid. The toner particles are formed with a plurality of fibers of tendrils from a thermoplastic polymer and carry a charge of a polarity opposite to the polarity of the latent electrostatic image. The polymer is insoluble or insolvatable in the dispersant liquid at room temperature. The toner particles are formed by plasticizing the polymer and pigment at elevated temperature and then either permitting a sponge to form and wet-grinding pieces of the sponge or diluting the plasticized polymer-pigment while cooling and constantaly stirring to prevent the forming of a sponge while cooling.

U.S. Pat. No. 4,130,670 (Gilliams et al.) discloses a sheet or web material for use in developing and fixing toner images which comprises a support and a thermoadhesive fixing layer defining the surface of the material on which the toner image is deposited. The thermoadhesive fixing layer comprises an organic polymeric material and has a surface resistance above $10^{10}$ ohm/square, freedom from blocking at least up to 35° C., a melt viscosity at 190° C. of not more than 120 P, and an abrasion resistance at 20° C. above 175 g. The process for fixing a toner image on this sheet or web material comprises the steps of image-wise depositing on the thermo-adhesive fixing layer toner particles forming a contact angle with the molten thermoadhesive fixing layer smaller than 90°, heating above 90° C. at least those parts of the layer corresponding with the toner images, said heating being of a sufficient intensity and duration that the particles sink within the softened fixing layer, and allowing the imaged layer to cool to fix the image particles in the layer.

U.S. Pat. No. 4,137,340 (Verlinden et al.) discloses a method for fixing a liquid toner image on a thermoadhesive layer of a recording material by irradiating the layer with high intensity short duration light pulses. The energy is sufficiently high to cause a partial melting of the layer so that the toner particles become absorbed thereon but the duration of the light pulse is sufficiently short to avoid a permanent deformation of the recording material itself.

Copending application U.S. Ser. No. 07/654,693 now abandoned, filed Feb. 13, 1991, entitled "Curable Liquid Developers With Heterogeneous Initiators", with the named inventors Ian D. Morrison, Bing R. Hsieh, and Jerry H. Taylor, the disclosure of which is totally incorporated herein by reference, discloses a liquid developer comprising a colorant and a substantial amount of a curable liquid vehicle having a viscosity of no more than about 500 centipoise and a resistivity of no less than about $10^8$ ohm-cm. One embodiment of the invention is directed to an electrophoretic liquid developer comprising a substantial amount of a curable liquid vehicle having a viscosity of no more than about 20 centipoise and a resistivity of no less than about $5\times10^9$ ohm-cm, a charge control agent, and colored particles capable of becoming charged and migrating through the liquid vehicle to develop an electrostatic latent image. Another embodiment of the invention is directed to a polarizable liquid developer comprising a colorant and a substantial amount of a curable liquid vehicle having a viscosity of from about 25 to about 500 centipoise and a resistivity of from about $10^8$ to about $10^{11}$ ohm-cm. Yet another embodiment of the invention is directed to a photoelectrophoretic liquid developer comprising a substantial amount of a curable liquid vehicle having a viscosity of no more than about 20 centipoise and a resistivity of no less than about $5\times10^9$ ohm-cm and photosensitive colored particles. A specific embodiment of the invention is directed to a liquid developer comprising a colorant, a substantial amount of a curable liquid vehicle having a viscosity of no more than about 500 centipoise and a resistivity of no less than about $10^8$ ohm-cm, and solid particles containing an initiator substantially insoluble in the liquid vehicle and capable, upon activation, of initiating polymerization of the curable liquid vehicle. In one embodiment, the colorant comprises pigment particles and the initiator is contained on the surfaces of the pigment particles. In another embodiment, the developer contains polymeric particles and the initiator is contained on the surfaces of the polymeric particles. In yet another embodiment, the colorant comprises toner particles which comprise a pigment and a polymer, and the initiator is contained on the surfaces of the toner particles. In still another embodiment, the initiator is contained on the surfaces of solid particles such as silicas, clays, or the like. The initiator can also be contained within the solid particles.

While known compositions and processes are suitable for their intended purposes, a need remains for liquid development compositions and processes that produce prints with little or substantially no odor. A need also remains for liquid development compositions and process that reduce or substantially eliminate the emission or carryout of solvent vapors from copiers and printers. Further, there is a need for liquid development compositions and processes that reduce or eliminate the need to dispose of solvents from a copier or printer employing liquid development. Additionally, there is a need for liquid development compositions and processes that enable the formation of high quality images on a wide variety of substrates. There is also a need for liquid development compositions and processes that enable easy handling of the developer material in that a solid material, as opposed to a liquid material, is used to replenish the developer. Further, there is a need for liquid development compositions and processes that enable easy disposal of the developer material in that a solid material, as opposed to a liquid material, is discarded from the machine. Additionally, there is a need for liquid development compositions and processes that reduce or eliminate the carryout of liquids from the imaging apparatus onto the final substrate or any intermediate transfer elements employed. There is also a need for liquid development compositions and processes that enable enhanced flexibility in the design of the imaging apparatus, particularly with respect to the location of the process elements around the imaging member

SUMMARY OF THE INVENTION

It is an object of the present invention to provide liquid development compositions and processes that produce prints with little or substantially no odor.

It is another object of the present invention to provide liquid development compositions and processes that reduce or substantially eliminate the emission or carryout of solvent vapors from copiers and printers.

It is yet another object of the present invention to provide liquid development compositions and processes that reduce or eliminate the need to dispose of solvents from a copier or printer employing liquid development.

It is still another object of the present invention to provide liquid development compositions and processes that enable the formation of high quality images on a wide variety of substrates.

Another object of the present invention is to provide liquid development compositions and processes that enable easy handling of the developer material in that a solid material, as opposed to a liquid material, is used to replenish the developer.

Yet another object of the present invention is to provide liquid development compositions and processes that enable easy disposal of the developer material in that a solid material, as opposed to a liquid material, is discarded from the machine.

Still another object of the present invention is to provide liquid development compositions and processes that reduce or eliminate the carryout of liquids from the imaging apparatus onto the final substrate or any intermediate transfer elements employed.

It is another object of the present invention to provide liquid development compositions and processes that enable enhanced flexibility in the design of the imaging apparatus, particularly with respect to the location of the process elements around the imaging member.

These and other objects of the present invention (or specific embodiments thereof) can be achieved by providing a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development. Another embodiment of the present invention is directed to a process for forming images which comprises (a) generating an electrostatic image; (b) developing the image with an electrophoretic developer comprising a substantial amount of a vehicle with a melting point of at least about 25° C., a charge control additive, and colored particles capable of becoming charged and migrating through the vehicle when the vehicle is in liquid form, said developer having a melting point of at least about 25° C., said contact occurring while the developer is maintained at a temperature at or above its melting point, said developer having a viscosity of no more than about 20 centipoise and a resistivity of no less than about $5\times10^9$ ohm-cm at the temperature maintained while the developer is in contact with the latent image; and (c) cooling the developed image to a temperature below its melting point subsequent to development. Yet another embodiment of the present invention is directed to a process for forming images which comprises (a) generating an electrostatic latent image on an imaging member; (b) providing an applicator having raised areas and depressed areas; (c) applying to the depressed areas of the applicator a developer comprising a colorant and a substantial amount of a vehicle with a melting point of at least about 25° C., said developer having a melting point of at least about 25° C.; (d) contacting the raised portions of the applicator with the imaging member while the developer is maintained at a temperature at or above its melting point, wherein said developer has a viscosity of from about 25 to about 500 centipoise and a resistivity of from about $10^8$ to about $10^{11}$ ohm-cm at the temperature maintained while the developer is in contact with the latent image, thus causing the image to attract the developer from the depressed portions of the applicator onto the latent image to develop the image; and (e) cooling the developed image to a temperature below its melting point subsequent to development. Still another embodiment of the present invention is directed to a process for forming images which comprises (a) placing a liquid developer comprising photosensitive colored particles and a substantial amount of a vehicle with a melting point of at least about 25° C. between at least two electrodes while maintaining the developer at a temperature above its melting point, said developer having a resistivity of no less than about $5\times10^9$ ohm-cm and a viscosity of no more than about 20 centipoise at the temperature maintained between the electrodes; (b) exposing the developer between the electrodes to a light image while applying a potential between the electrodes and maintaining the developer at a temperature above its melting point, thereby causing the formation of an image by deposition of the suspended particles in imagewise configuration on the electrodes; and (c) cooling the developed image to a temperature below its melting point subsequent to development.

BRIEF DESCRIPTION OF THE DRAWING

The FIGURE illustrates schematically a specific embodiment of the present invention wherein the developer is coated onto a web and is then transferred in imagewise fashion to an electrostatic latent image.

DETAILED DESCRIPTION OF THE INVENTION

During the process of the present invention, typically all machine parts that come into contact with the developer during development are heated to a temperature above the melting point of the developer and above the melting point of the vehicle. The development apparatus and processes employed for the present invention generally are similar to the well-known apparatus and processes employed with conventional liquid developers with the exception that the apparatus is equipped with a means for maintaining the developer at a temperature above its melting point during the development process. For example, the developer reservoir, the developer delivery system, and the developer housing, including the surface containing the electrostatic latent image, generally are all maintained at a temperature above the melting point of the developer during development. These components need not be maintained all at the same temperature, since different temperatures and the different viscosities resulting from differenttemperatures can be useful in enhancing the transfer of a developed image. One method for elevating the temperature of the development components is to maintain the entire imaging apparatus at an elevated temperature. Another method is to maintain only the necessary components (such as the developer reservoir, developer delivery system, developer housing, imaging surface, and the like) of the apparatus at an elevated temperature. Heating can be accomplished by any suitable method. For example, a flow of heated air can be directed past some or all of the necessary components. Additionally, heating elements such as electrical coils, lamps, or the like, can be placed near or built into the structure of some or all of the necessary components. For example, the imaging member, the development housing, and the developer reservoir can all have heating elements associated therewith. In electrophoretic development processes, generally the bath through which the electrostatic latent image is transported will be heated. In polarizable liquid development processes, generally the gravure roller and at least that part of the receiving surface in contact with the gravure roller will be heated. In photoelectrophoretic development processes, generally the zone between the two electrodes will be heated.

Additionally, it may be desirable to provide a two-station developer reservoir, the first station being maintained at a temperature below the melting point of the developer, typically room temperature, and containing the developer in solid form, and the second station being maintained at a temperature above the melting point of the developer and containing the developer in liquid form. Optionally, the developer delivery system and the developer housing can be equipped with means for draining the developer from these components while it is in liquid form, prior to shutting down the heating system. In addition, it may be desirable to provide a heated cleaning system for the imaging member surface so that excess developer can be removed as a liquid. Further, it may be desirable to provide an excess developer waste system which can be heated when desired to coalesce excess developer into a liquid and then cooled to allow it to solidify prior to disposal. It may also be desirable to provide a means for heating intermediate surfaces so that the image can be transferred from surface to surface as a liquid. Additionally, it may be desirable to heat the substrate, such as paper, transparency material, or the like, to which the image is to be finally transferred so that the developer adheres well to this surface prior to solidification.

Another method of applying the developer to the latent image entails coating the developer onto a web. The web is wound onto a roll, and during development, the web is passed over a heating element, such as a heated roller or the like, which heats the ink coating on the web to a temperature above its melting point. The portion of the web heated by the heating element is in sufficient proximity to the imaging member bearing the electrostatic latent image to enable the colored particles in the wax to be attracted to the imaging member in imagewise fashion. If desired, the surface of the web opposite to that coated with the ink can be metallized to enable higher heat conduction to facilitate surface melting of the ink. This method is illustrated schematically in the Figure. As shown, web 1 coated with ink layer 3 and having metal backing 5 is wound onto supply roll 7. The web passes from supply roll 7 to take-up roll 9 in the direction of the arrow, passing over heating element 11, which can be a gravure roller, a smooth roller, or the like. Heating element 11 is heated to a temperature sufficient to cause the ink in region 13 to melt and then to be attracted in imagewise fashion to an electrostatic latent image on imaging member 15. From imaging member 15, the developed image can then be transferred to an intermediate transfer member (not shown) or directly to a final substrate 17.

Yet another method of applying the developer to the latent image, suitable for use in processes wherein colored particles migrate through the developer vehicle, entails direct contact of the developer in solid form, such as a bar, roll, or the like, to a heated imaging member bearing an electrostatic latent image. The heated solid developer thus forms a uniform liquid coating on the imaging member bearing the latent image. The colored particles in the developer migrate selectively to the image areas. Subsequently, any colored particles remaining in background areas on the imaging member can be removed by passing a biased metering roll over the imaging member; the metering roll also removes excess developer vehicle in both image and non-image areas. Excess developer vehicle remaining on the imaging member can also be removed subsequent to development by other mechanical means if desired, such as by blotting the liquid onto an absorptive element (such as a roller, a web, or the like).

For electrophotographic imaging methods, photoreceptors formulated from arsenic triselenide, amorphous silicon, or the like may be particularly preferred for the process of the present invention, since they operate well at elevated temperatures. Organic photoconductors can also be employed, particularly in instances wherein the organic photoreceptor contains a protective surface chemical treatment, such as a silane coating, which forms a strong chemically bonded molecular film via coupling agents, as disclosed in, for example, E. Plueddeman, "Role of Silanes in Polymer-Polymer Bonding," ACS Symposium: Surface & Colloid Science in Computer Technology, Potsdam, N.Y., Jun. 24–28, 1985 (Print Plenum Press), the disclosure of which istotally incorporated herein by reference.

Developer compositions suitable for the process of the present invention generally comprise a liquid vehicle having a melting point of over 25° C. and a colorant. The vehicle typically is a material such as a hydrocarbon (containing only carbon and hydrogen atoms), including n-octadecane ($C_{18}H_{38}$, melting point (mp)=28° C.), n-nonadecane ($C_{19}H_{40}$, mp=32° C.), n-eicosane ($C_{20}H_{42}$, mp=36° C.), n-heneicsane ($C_{21}H_{44}$, mp=41° C.), n-docosane ($C_{22}H_{46}$, mp=44° C.), n-tricosane ($C_{23}H_{48}$, mp=49° C.), n-tetracosane ($C_{24}H_{50}$, mp=51° C.), n-pentacosane ($C_{25}H_{52}$, mp=54° C.), and the like, hydrocarbon waxes, such as the Slack Waxes (low oil content hydrocarbon waxes available from Exxon Co., Houston, Tex.), including Slack Wax 100 (mp=120° F.), Slack Wax 150 (mp=131° F.), Slack Wax 200 (mp=132° F.), Slack Wax 600 (mp=145° F.), and the like, the Parvan waxes (refined hydrocarbon waxes available from Exxon Co., Houston, Tex.), including Parvan 127 (mp=127° F.), Parvan 129 (mp=129° F.), Parvan 131 (mp=131° F.), Parvan 137 (mp=137° F.), Parvan 138 (mp=138° F.), Parvan 142 (mp=142° F.), Parvan 145 (mp=145° F.), Parvan 147 (mp=147° F.), and the like, the Shellwax series (paraffin and microcrystalline waxes available from Shell Oil Co., Houston, Tex.), including Shellwax 100 (mp=123° F.), Shellwax 120

(mp=130° F.), Shellwax 200 (mp=141° F.), Shellwax 270 (mp=141° F.), and the like. Preferably, the selected vehicle exhibits relatively high oxidative stability, particularly when the developer is of a pale color such as yellow, so that no undesirable color changes occur as a result of oxidation of the vehicle. High oxidative stability is also preferred to prevent rancidity and undesirable odors. In addition, it is generally preferred that the vehicle selected be obtained in relatively pure form, since impurities can affect the conductivity of the vehicle; if, however, the impurities do not adversely affect the conductivity or viscosity in an undesirable manner, they may be tolerated.

The vehicle typically is a solid at room temperature (20 to 25° C.) and has a melting point of at least 25° C. There is no upper limit on the melting point other than that temperature which is practical to implement in a development apparatus so that development occurs at a temperature above the melting point of the vehicle and the developer and at a temperature at which the vehicle has the requisite viscosity and resistivity values. Ionographic processes typically will be more tolerant of high temperature development processes than electrophotographic processes since ionographic imaging members typically are less sensitive to heat than are photosensitive imaging members. Typical vehicle melting points range from over 25° C. to about 150° C., preferably from about 30° C. to about 55° C., although the vehicle melting point can be outside this range. The vehicle is selected so that the viscosity of the developer at the temperature selected for development is no more than about 500 centipoise. For electrophoretic liquid development processes and photoelectrophoretic liquid development processes, the viscosity of the developer at the temperature selected for development is no more than about 20 centipoise, and preferably no more than about 3 centipoise. For polarizable liquid development processes, the viscosity of the developer at the temperature selected for development is from about 25 to about 500 centipoise, and preferably from about 30 to about 300 centipoise. In addition, the vehicle is selected so that the resistivity of the developer at the temperature selected for development is no less than about $10^8$ ohm-cm. For electrophoretic liquid development processes and photoelectrophoretic liquid development processes, the resistivity of the developer at the temperature selected for development is no less than about $5\times10^9$ ohm-cm, and preferably no less than about $10^{10}$ ohm-cm. For polarizable liquid development processes, the resistivity of the developer at the temperature selected for development is from about $10^8$ to about $10^{11}$ ohm-cm, and preferably from about $2\times10^9$ to about $10^{10}$ ohm-cm.

In addition to pure materials which are solid at room temperature and liquid at temperatures above room temperature, mixtures of two or more materials, wherein the mixtures exhibit the desired characteristics, are also suitable for the vehicle of the developers employed in the present invention. For example, a mixture of a hydrocarbon which is liquid at room temperature and a hydrocarbon which is solid at room temperature may exhibit the characteristics necessary for the developer vehicles of the present invention, namely a melting point above room temperature and the requisite viscosity and conductivity characteristics at the desired development temperature. Mixtures of materials may have cost benefits over pure materials while exhibiting similar characteristics. For example, a paraffinic hydrocarbon which is a non-volatile liquid at room temperature, such as a mixture of $C_{15}$ to $C_{17}$ linear aliphatic hydrocarbons ($C_{16}$), can be admixed with a solid hydrocarbon having a relatively high melting point, such as the Slack Wax materials or the Parvan materials available from Exxon, to form suitable vehicles. Examples of two of such mixtures are indicated in the table below; as can be seen, the characteristics of the mixtures are similar to the characteristics of a pure material which is also a suitable vehicle:

| | | Equilibrium Vapor Concentration[2] | |
|---|---|---|---|
| Hydrocarbon | Viscosity @ 40° C. | 20° C. | 40° C. |
| 54:46 mixture[1] of PARVAN 127/$C_{16}$ | 3.3 centipoise[3] | 0.3 ppm[3] | 1.8 ppm[3] |
| 23:77 mixture[1] of PARVAN 127/$C_{16}$ | 2.3 centipoise[3] | 0.4 ppm[3] | 2.6 ppm[3] |
| n-Octadecane | 3.1 centipoise[3] | 0.0 ppm[4] | 0.7 ppm[4] |

[1]By weight
[2]Calculated using Raoult's law
[3]Measured value
[4]Literature value Additional examples of materials that are liquid at room temperature and suitable components for mixtures to form the developer vehicles of the present invention include hydrocarbons, preferably with a viscosity of from about 0.5 to about 500 centipoise, more preferably from about 1 to about 20 centipoise, and preferably with a resistivity greater than about $5\times10^9$ ohm-cm. There is not believed to be any upper limit on the resistivity value of suitable liquids; materials with resistivities of greater than $10^{13}$ ohm-cm are known to be suitable. Preferably, the liquid selected is a branched or linear aliphatic hydrocarbon. A non-polar liquid of the ISOPAR® series (available from Exxon) may also be used as a component in the mixture. These hydrocarbon liquids are considered narrow portions of isoparaffinic hydrocarbon fractions with extremely high levels of purity. For example, ISOPAR® L has a boiling point between about 188° C. and 206° C.; ISOPAR® M has a boiling point between about 207° C. and 254° C.; and ISOPAR® V has a boiling point between about 254.4° C. and 329.4° C. ISOPAR® L has a mid-boiling point of approximately 194° C. ISOPAR® M has an auto ignition temperature of 338° C. ISOPAR® L has a flash point of 61° C. as determined by the ASTM D-56 method, and ISOPAR® M has a flash point of 80° C. as determined by the ASTM D-56 method. The liquids selected preferably have an electrical volume resistivity in excess of about $10^9$ ohm-cm and a dielectric constant below about 3.0. Moreover, the vapor pressure at 25° C. preferably is less than about 10 torr in preferred embodiments. While the ISOPAR® series liquids are suitable non-polar liquids for admixture with solids to form developer vehicles in the developers of the present invention, the essential characteristics of viscosity and resistivity can be met with other suitable liquids. Specifically, the NORPAR® series available from Exxon Corporation, the SOLTROL series available from Phillips Petroleum Company, and the SHELLSOL series available from Shell Oil Company can be selected. Normal hydrocarbons from $C_{12}$ to $C_{17}$ can be selected, with pentadecane and hexadecane being preferred because of their low vapor pressures and low melting point. Mineral oils can also be employed.

Additional examples of materials that are solid at room temperature and suitable components for mixtures to form the developer vehicles of the present invention include all materials listed previously herein as suitable developer vehicles which are solid at about 25° C., as well as $C_{26}$ to $C_{30}$ saturated hydrocarbons and multiwaxes and microcrystalline waxes (available from Witco Corporation, Sonneborn Division, New York, N.Y.), including multiwax 180-M (melting point 82 to 88° C.), ML-445 (melting point 77 to 82° C.), HS (melting point 71 to 77° C.), and X-145A (melting point 71 to 77° C.). Petrolite Corporation, Polymers Division, Tulsa, Okla. also supplies suitable microcrystalline waxes, such as ULTRAFLEX (mp=69° C.), VICTORY® (mp=79° C.), and STARWAX® 100 (mp=88° C.).

Further, the developer vehicle can comprise a mixture of a liquid hydrocarbon and a metal soap which is insoluble in the liquid at room temperature. The insoluble metal soap forms a dense, ramified network when the mixture is at room temperature, but when the mixture is heated, its viscosity undergoes a sudden decrease to liquid form; thus, such a mixture is suitable as a vehicle for the developers employed in the present invention. Examples of suitable liquids for mixtures of this type include hydrocarbons, preferably with a viscosity of from about 0.5 to about 500 centipoise, more preferably from about 1 to about 20 centipoise, and preferably with a resistivity greater than about $5\times10^9$ ohm-cm. There is not believed to be any upper limit on the resistivity value of suitable liquids; materials with resistivities of greater than $10^{13}$ ohm-cm are known to be suitable. Preferably, the liquid selected is a branched chain aliphatic hydrocarbon. A non-polar isoparaffinic hydrocarbon liquid of the ISOPAR® series (available from Exxon) may also be used as a component in the mixture. While the ISOPAR® series liquids are the preferred non-polar liquids for admixture with metal soaps to form developer vehicles in the developers of the present invention, the essential characteristics of viscosity and resistivity can be met with other suitable liquids. Specifically, the NORPAR® series available from Exxon Corporation, the SOLTROL® series available from Phillips Petroleum Company, and the SHELLSOL series available from Shell Oil Company can be selected. Normal hydrocarbons from $C_{12}$ to $C_{17}$ can be selected, with pentadecane and hexadecane being preferred because of their low vapor pressures and low melting point. Mineral oils can also be employed. Any suitable metal soap can be employed. Metallic soaps include, for example, salts of monocarboxylic acids, such as a higher fatty acid, resin acid, naphthenic acid, or the like, with a metal, such as calcium, cobalt, zinc, copper, lead, aluminum, sodium, or the like, that typically is insoluble in water but soluble in benzene. Typical metal soaps are alkali and alkaline earth metal soaps of fatty acids and fatty materials having from about 12 to about 30 carbon atoms per molecule. The metals are typified by sodium, lithium, calcium, barium, and the like. Fatty materials are illustrated by stearic acid, hydroxy-stearic acid, stearin, cottonseed oil acids, oleic acid, palmitic acid, myristic acid, hydrogenated fish oils, other carboxylic acids derived from tallow, hydrogenated fish oil, castor oil, wool grease, rosin, and the like. Examples of suitable metal soaps include complex calcium soap salts from the reaction of calcium hydroxide, 12-hydroxystearic acid, and acetic acid (calcium complexes often include a minor amount of calcium acetate); calcium, lithium, and sodium soaps of dibasic acids prepared from monohydroxy fatty acids; aluminum complex soaps from the reaction of stearic and benzoic acids; mixtures of aluminum, barium, calcium-complex, lithium, and/or sodium soaps; cadmium, cobalt, magnesium, nickel, mercury, and strontium soaps; soaps of calcium, aluminum, magnesium, and zinc, either alone or in combination with other materials; fatty acid soaps of lithium, calcium, sodium, aluminum, and/or barium; combinations of stearic acid and benzoic acid with aluminum isoperoxide, finely divided clay particles of bentonite, attapulgite, and montmorillonite surface coated with an organic material such as a quaternary ammonium compound; silica particles surface coated with an organic material such as a quaternary ammonium compound; soaps produced from carboxylic acids or their glycerides (fats and oils) and alkali metal or alkaline earth metal hydroxides and alkoxides; calcium soaps of 12-hydroxystearate;lithium 12-hydroxy stearate; hydroxyaluminum-bis(2-ethylhexanoate); aluminum soaps, barium soaps, sodium soaps, mixed soaps such as sodium-calcium, lithium-calcium, sodium-lithium-calcium, and the like; complex soaps from aluminum, barium, sodium, calcium, and lithium salts with short-chain carboxylic acids, such as acetic acid or the like, or inorgainc salts, such as carbonates; synthetic soaplike salts, sucy as alkali metal and alkaline earth salts of terephthalic acid, sodium salts of sebacic acid N-laurylamide, N- octadecylterephthalate, N-lauroyl-6-aminocaproate, and the like; salts of acids without carboxyl groups, such as calcium salt of N-stearoylsulfanilic acid, lithium propylphosphate, lithium stearamidomethane phosphonate, metal alkylthiophosphonates, and the like; inorganic thickeners, such as silica (precipitated or finely dispersed from the gas phase) rendered hydrophobic by treatment with diisocyanates or epoxides to improve water resistance; organophilic bentonites (montmorillonite, hectorite) obtained by the exchange of sodium ions with quaternary ammonium ions; and the like, as well as mixtures thereof. Metal soaps are well known and discussed in detail in, for example, *Kirk-Othmer Encyclopaedia of Chemical Technology*, 3rd Ed., Wiley, New York (1984), Volume 8, p.45–46 on Driers and Metallic Soaps and Vol. 14, p.501–503 on Lubrication and Lubricants; and in *Ullmann's Encyclopaedia of Industrial Chemistry*, VCH, New York (1990), Vol. A15, p.489–495 on Lubricating Greases; the disclosures of each of which are totally incorporated herein by reference. Metal soaps are also disclosed in, for example, U.S. Pat. Nos. 2,197,263, 2,564,561, 2,999,065, 2,999,066, 4,707,429, 4,702,984, and 4,702,985, the disclosures of each of which are totally incorporated herein by reference. The liquid hydrocarbon and metal soap are admixed in any suitable relative amounts at a temperature above the melting point of the soap in the hydrocarbon and allowed to cool to a solid hydrocarbon at room temperature; typically, the metal soap is present in an amount of at least about 4 percent by weight, preferably from about 4 to about 40 percent by weight, more preferably from about 4 to about 20 percent by weight, and even more preferably from about 8 to about 25 percent by weight, and the liquid hydrocarbon is present in an amount of up to about 96 percent by weight, preferably from about 60 to about 96 percent by weight, more preferably from about 80 to about 96 percent by weight, and even more preferably from about 75 to about 92 percent by weight, although the amounts can be outside these ranges.

A distinction exists between the melting point, viscosity, and resistivity of the material selected as the primary component of the vehicle and the melting point, viscosity, and resistivity of the entire developer. Additional optional ingredients can be introduced into a mixture of vehicle and colorantto modify these characteristics. For example, mixtures of high melting and low melting materials can be formulated, wherein the low melting material may itself be a liquid at room temperature. Viscosity can be modified by the use of mixtures of structural isomers, wherein the mixture of isomers has a lower melting point that that of either isomer in its pure form; examples of such materials include branched and straight chain aliphatic hydrocarbons, racemic mixtures of stereoisomers, or the like. Resistivity can be modified by the addition of nonaqueous association colloids that form inverse micelles or other lyophilic structures or by the addition of salts of large anions and cations such as the metallic soaps.

Generally, the vehicle component of the developers of the present invention is present in a large amount, and constitutes that percentage by weight of the developer not accounted for by the other components. The vehicle is typically present in an amount of from about 80 to about 99 percent by weight, although the amount may vary from this range provided that the objectives of the present invention are achieved.

The developers of the present invention can also include a charge control agent to help impart a charge to the colored toner particles. A charge control additive is generally present in the electrophoretic developers and the photoelectrophoretic developers of the present invention to impart to the particles contained in the vehicle a charge sufficient to enable them to migrate through the vehicle to develop an image when the developer is in the liquid state. Examples of suitable charge control agents for the developers include the lithium, cadmium, calcium, manganese, magnesium and zinc salts of heptanoic acid; the barium, aluminum, cobalt, manganese, zinc, cerium and zirconium salts of 2-ethyl hexanoic acid, (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diisopropyl salicylate, aluminum resinate, aluminum salt of 3,5 di-t-butyl gamma resorcylic acid. Mixtures of these materials may also be used. Particularly preferred charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc with heptanoic acid; salts of barium, aluminum, cobalt, manganese, zinc, cerium, and zirconium octoates; salts of barium, aluminum, zinc, copper, lead, and iron with stearic acid; iron naphthenate; and the like, as well as mixtures thereof. The charge control additive may be present in any effective amount; typical amounts are from about 0.001 to about 3 percent by weight, and preferably from about 0.01 to about 0.8 percent by weight of the developer composition, although the amount can be outside these ranges. Other additives, such as charge adjuvants added to improve charging characteristics of the developer, may be added to the developers of the present invention, provided that the objectives of the present invention are achieved. Charge adjuvants such as stearates, metallic soap additives, polybutylene succinimides, and the like are described in references such as U.S. Pat. Nos. 4,707,429, 4,702,984, and 4,702,985, the disclosures of each of which are totally incorporated herein by reference. In addition, compounds analogous to these materials which generally are not employed in liquid developers with vehicles that are liquid at room temperature because of poor solubility characteristics in the liquid vehicle may be suitable for the developers of the present invention, since the increased temperature at which development occurs in the processes of the present invention may render these materials suitable under the conditions employed for development.

The developers of the present invention can contain any kind of colored toner particle typically used in conventional liquid developers and compatible with the vehicle. For example, the toner particles can consist solely of pigment particles dispersed in the vehicle. Since the vehicle is cooled to a solid before or after transfer to a substrate, the pigment particles can become affixed to the print substrate by the solidified vehicle, and no additional polymeric component is required in the developer for fixing purposes. If desired, however, a polymeric component can be present in the developer. The polymer can be soluble in the vehicle, and can include polymers such as poly(2-ethyl hexylmethacrylate); poly(isobutylene-co-isoprenes), such as Kalene 800, available from Hardman Company, N.J.; polyvinyl toluene-based copolymers, including vinyl toluene acrylic copolymers such as Pliolite OMS, Pliolite AC, Pliolite AC-L, Pliolite FSA, Pliolite FSB, Pliolite FSD, Pliolite FSE, Pliolite VT, Pliolite VT-L, Pliolite VTAC, and Pliolite VTAC-L, available from the Goodyear Tire and Rubber Company, Neocryl S-1002 and EX519, available from Polyvinyl Chemistry Industries, Parapol 900, Parapol 1300, and Parapol 2200, available from Exxon Company, and the like; block copolymers such as poly(styrene-b-hydrogenated butadiene), including Kraton G 1701, available from Shell Chemical Company; and the like, as well as mixtures thereof, as disclosed in, for example, copending application U.S. Ser. No. 07/369,003, the disclosure of which is totally incorporated herein by reference. In addition, the polymer can be insoluble in the vehicle, and can be present either as separate particles or as an encapsulating shell around the pigment particles. Examples of suitable polymers in this instance include ethylene-vinyl acetate copolymers such as the ELVAX® I resins available from E.I. Du Pont de Nemours & Company, copolymers of ethylene and an $\alpha$, $\beta$-ethylenically unsaturated acid selected from acrylic or methacrylic acid, where the acid moiety is present in an amount of from 0.1 to 20 percent by weight, such as the NUCREL® resins available from E.I. Du Pont de Nemours & Company, polybutyl terephthalates, ethylene ethyl acrylate copolymers such as those available as Bakelite DPD 6169, DPDA 6182 Natural, and DTDA 9169 Natural from Union Carbide Company, ethylene vinyl acetate resins such as DQDA 6479 Natural 7 and DQDA 6832 Natural 7 avalable from Union Carbide Company, methacrylate resins such as polybutyl methacrylate, polyethyl methacrylate, and polymethyl methacrylate, available under the trade name Elvacite from E.I. Du Pont de Nemours & Company, and others as disclosed in, for example, British Patent 2,169,416 and U.S. Pat. No. 4,794,651, the disclosures of which are totally incorporated herein by reference. Further, the polymer can be partially soluble in the vehicle, or soluble in the vehicle at elevated temperatures of, for example, over 75° C. and insoluble at ambient temperatures of, for example, from about 25° C. to about 65° C. Examples of suitable polymers in this instance include polyolefins and halogenated polyolefins, such as chlorinated polypropylenes and poly-$\alpha$-olefins, including polyhexadecenes, polyoctadecenes, and the like, as disclosed in copending application U.S. Ser. No. 07/300,395, the disclosure of which is totally incorporated herein by reference.

Suitable pigment materials include carbon blacks such as Microlith® C.T, available from BASF, Printex® 140 V, available from Degussa, Raven® 5250 and Raven® 5720, available from Columbian Chemicals Company, and Mogul-L, Black Pearls L, and the Regal carbon blacks from Cabot Corporation. Pigment materials may be of colors other than black, and may include magenta pigments such as Hostaperm Pink E (Hoechst Celanese Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it either combines well with any polymeric material also included in the developer composition or is suitable in itself as a toner particle in that it is of the desired particle size and, in the electrophoretic and photoelectrophoretic embodiments of the present invention, is capable of becoming charged and migrating through the vehicle to develop an image. The pigment particles are present in any amount sufficient to enable development of a colored image, typically from about 5 to about 100 percent by weight of the non-vehicle content of the developers of the present invention, although the amount can be outside this range. Polymeric components, when present, are present in any amount, typically up to about 95 percent by weight of the non-vehicle component of the developers of the instant invention, although the amount can be outside this range.

Examples of photosensitive pigments suitable for use in the photoelectrophoretic developers of the present invention are disclosed in, for example, U.S. Pat. No. 3,384,488, the disclosure of which is totally incorporated herein by reference. This patent also discloses additional materials, such as charge transfer materials, that can be contained in the photoelectrophoretic developers of the present invention.

In all instances wherein a pigment is a component of the developer, the pigment can be a "flushed" pigment. Flushed pigments generally are those pigments that are sold in a form readily suitable for dispersion into organic media. Pigments often are manufactured by an aqueous precipitation reaction, and the product is collected in a water-wet pigment cake by filtration. The cake is then dried to obtain a dry pigment powder. Flushed pigments, however, are not dried to powder; instead, the filter cake is mixed with an organic solvent such as mineral oils, litho oils, or gloss ink varnishes, until a phase transfer occurs in which the pigment spontaneously transfers from the aqueous phase to the organic phase during stirring. Employing flushed pigments for the developers of the present invention results in advantages such as a reduced need for mixing and processing of the developer during formulation to obtain desirable pigment particle sizes, since the particles are already small in the organic dispersion. In addition, the organic pigment dispersion can be mixed readily with a variety of vehicles. A developer of the present invention can be prepared from flushed pigments by simple mixing of the flushed pigment with the vehicle and the other developer ingredients at a temperature at or above the melting point of the vehicle. Examples of flushed pigments suitable for the present invention include Alkyd Based, Sunset II, Quantum Set II, Polyversyl, and Valuset II flushes from Sun Chemical Corporation, and the like. Further information regarding flushed pigments is disclosed in, for example, U.S. Pat. No. 4,794,066, the disclosure of which is totally incorporated herein by reference.

Additional references disclosing suitable toner particles include U.S. Pat. Nos. 4,794,651, 4,762,764, 3,729,419, 3,841,893, and 3,968,044, the disclosures of each of which are totally incorporated herein by reference.

In embodiments of the present invention such as developers and processes employing polarizable liquid development, the developer can contain a dye instead of pigment particles. The dye is present in any effective amount, typically from about 0.05 to about 10 percent by weight of the developer and preferably from about 0.5 to about 3 percent by weight of the developer, although the amount can be outside of these ranges. Further, in embodiments of the present invention wherein colored particles migrate through the liquid medium to form images, the particles can be colored with a dye instead of with a pigment. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R, available from Aldrich, Neolan Blue, available from Ciba-Geigy, Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present provided that the objectives of the present invention are achieved.

The developers of the present invention can also contain various polymers added to modify the viscosity of the developer or to modify the mechanical properties of the developed or cured image such as adhesion or cohesion. In particular, when the developer of the present invention is intended for use in polarizable liquid development processes, the developer can also include viscosity controlling agents. Examples of suitable viscosity controlling agents include thickeners such as alkylated polyvinyl pyrrolidones, such as Ganex V216, available from GAF; polyisobutylenes such as Vistanex, available from Exxon Corporation, Kalene 800, available from Hardman Company, New Jersey, ECA 4600, available from Paramins, Ontario, and the like; Kraton G-1701, a block copolymer of polystyrene-b-hydrogenated butadiene available from Shell Chemical Company, Polypale Ester 10, a glycol rosin ester available from Hercules Powder Company; and other similar thickeners. In addition, additives such as pigments, including silica pigments such as Aerosil 200, Aerosil 300, and the like available from Degussa, Bentone 500, a treated montmorillonite clay available from NL Products, and the like can be included to achieve the desired developer viscosity. Additives are present in any effective amount, typically from about 1 to about 40 percent by weight in the case of thickeners and from about 0.5 to about 5 percent by weight in the case of pigments and other particulate additives.

In addition, developers of the present invention intended for use in polarizable liquid development processes can also contain conductivity enhancing agents. For example, the developers can contain additives such as quaternary ammonium compounds as disclosed in, for example, U.S. Pat. No. 4,059,444, the disclosure of which is totally incorporated herein by reference.

In one embodiment of the present invention, the vehicle portion of the developer contains a curable material, such as materials that become polymerized or crosslinked under certain conditions, such as exposure to ultraviolet light, heating in the presence of an initiator, or other means such as those disclosed in, for example, copending application U.S. Ser. No. 07/654,693, the disclosure of which is totally incorporated herein by reference. In one specific embodiment, the vehicle either contains as a component or consists entirely of monomers that are solid at room temperature and have melting points of at least 25° C. Development of the image takes place as described herein for the developers of the present invention. Subsequent to development and prior to, during, or subsequent to any transfer step from the imaging member to a substrate such as paper, transparency material, or the like, the image is cured by exposing the monomers to curing conditions suitable for the material, such as heat, ultraviolet radiation, or the like, while maintaining the image at a temperature at or above the melting point of the developer. The image thus becomes cured to a solid. Advantages of including curable materials in the developers of the present invention include increased image resilience, resistance to abrasion, reduced blocking, greater image permanence, and decreased offset. The curable material can comprise from 0 to 100 percent of the vehicle, and typically is present in an amount of from about 10 to about 100 percent by weight of the vehicle, preferably from about 50 to about 100 percent by weight of the vehicle. Examples of suitable monomers that are solid at room temperature include (but are not limited to) acrylate and methacrylate monomers and polymers containing acrylic or methacrylic groups in which the active group is attached to an aliphatic or aromatic group having more than about 16 carbon atoms, or to an aliphatic or aromatic siloxane chain or ring having more than about 5 dimethyl siloxane units, or to a combination of the aforementioned groups, or to a polymer chain. Also suitable are epoxy monomers and epoxy containing polymers having one or more epoxy functional groups, wherein the active group is attached to an aliphatic or aromatic group having more than about 16 carbon atoms, or to an aliphatic or aromatic siloxane chain or ring having more than about 5 dimethyl siloxane units, or to a combination of the aforementioned groups, or to a polymer chain. Further examples of suitable curable materials include vinyl ether monomers, oligomers, and polymers containing vinyl ether groups, wherein the active group is attached to an aliphatic or aromatic group having more than about 16 carbon atoms, or to an aliphatic or aromatic siloxane chain or ring having more than about 5 dimethyl siloxane units, or to a combination of the aforementioned groups, or to a polymer chain. Also suitable are styrene and indene monomers, oligomers, and polymers containing styrenic or indenic groups wherein the active group is attached to an aliphatic or aromatic group having more than about 16 carbon atoms, or to an aliphatic or aromatic siloxane chain or ring having more than about 5 dimethyl siloxane units, or to a combination of the aforementioned groups, or to a polymer chain. Further, linear or branched aliphatic $\alpha$-olefins having more than about 20 carbon atoms are suitable materials. Other curable materials include those containing moieties such as cinnamic groups, fumaric groups, maleic groups, maleimido groups, and the like, provided that the material is a solid at room temperature. In addition, monomers, dimers, and oligomers containing a multiplicity of one or more suitable functional groups can also be employed.

Optionally, when the developer contains a curable component, the developer can contain a crosslinking agent. Crosslinking agents generally are monomers, dimers, or oligomers containing a multiplicity of functional groups, such as two styrene functionalities, a styrene functionality and an acrylate functionality, or the like. The curable component can consist entirely of these multifunctional monomers, dimers, or oligomers, can contain no crosslinking agent at all, and can contain both monofunctional monomers, dimers, or oligomers and multifunctional monomers or oligomers. Generally, the presence of a crosslinking agent is preferred to provide improved film forming characteristics, faster curing, and improved adhesion of the cured image to the substrate. When present, the crosslinking agent is present in an effective amount, typically from about 1 to about 100 percent by weight of the curable component and preferably from about 10 to about 50 percent by weight of the curable component.

When a curable component is present, the developers of the present invention can also contain an initiator to initiate curing of the curable material. The initiator can be added before or after development of the image. Any suitable initiator can be employed provided that the objectives of the present invention are achieved; examples of the types of initiators suitable include thermal initiators, radiation sensitive initiators such as ultraviolet initiators, infrared initiators, visible light initiators, or the like, initiators sensitive to electron beam radiation, ion beam radiation, gamma radiation, or the like. In addition, combinations of initiators from one or more class of initiators can be employed. Radical photoinitiators and radical thermal initiators are well known, as is electron beam curing; these materials and processes are disclosed in, for example, "Radiation Curing of Coatings," G. A. Senich and R. E. Florin, *Journal of Macromolecular Science Review. Macromol. Chem. Phys.*, C24(2), 239–324 (1984), the disclosure of which is totally incorporated herein by reference. Examples of initiators include those that generate radicals by direct photofragmentation, including benzoin ethers such as benzoin isobutyl ether, benzoin isopropyl ether, benzoin methyl ether and the like, acetophenone derivatives such as 2,2-dimethoxy-2-phenylacetophenone, dimethoxyacetophenone, 4-(2-hydroxyethoxy)phenyl-(2-propyl)ketone, 2-hydroxy-2-methyl-1-phenyl-propan-1-one, 2,2,2-trichloroacetophenone, 2,4,6-trimethylbenzoyldiphenylphospine oxide, and the like; initiators that form radicals by bimolecular hydrogen transfer, such as the photoexcited triplet state of diphenyl ketone or benzophenone, diphenoxybenzophenone, bis(N,N-dimethylphenyl) ketone or Michler's ketone, anthraquinone, 4-(2-acryloyl-oxyethyoxy)-phenyl-2-hydroxy-2-propylketone and other similar aromatic carbonyl compounds, and the like; initiators that form radicals by electron transfer or via a donor-acceptor complex, also known as an exciplex, such as methyldiethanolamine and other tertiary amines; photosensitizers used in combination with a radical generating initiator, wherein the sensitizer absorbs light energy and transfers it to the initiator, such as a combination of a thioxanthone sensitizer and a quinoline sulfonyl chloride initiator and similar combinations; cationic initiators that photolyze to strong Lewis acids, such as aryldiazonium salts of the general formula $Ar\text{-}N_2^+X^-$ wherein Ar is an aromatic ring such as butyl benzene, nitrobenzene, dinitrobenzene, or the like and X is $BF_4$, $PF_6$, $AsF_6$, $SbF_6$, $CF_3SO_3$, or the like, diaryliodonium salts of the general formula $Ar_2I^+X^-$, wherein Ar is an aromatic ring such as methoxy benzene, butyl benzene, butoxy benzene, octyl benzene, didecyl benzene, or the like, and X is an ion of low nucleophilicity, such as $PF_6$, $AsF_6$, $BF_4$, $SbF_6$, $CF_3SO_3$, and the like; triarylsulfonium salts of the general formula $Ar_3S^+X^-$, wherein Ar is an aromatic ring such as hydroxy benzene, methoxy benzene, butyl benzene, butoxy benzene, octyl benzene, dodecyl benzene, or the like and X is an ion of low nucleophilicity, such as $PF_6$, $AsF_6$, $SbF_6$, $BF_4$,$CF_3SO_3$, or the like; nonradical initiators comprising amine salts of alpha-ketocarboxylic acids, such as the tributyl ammonium salt of phenylglyoxylic acid; and the like, as well as mixtures thereof. Further photoacid generating initiators are disclosed in "The Chemistry of Photoacid Generating Compounds," by J. V. Crivello in *Proceedings of the ACS Division of Polymeric Materials: Science and Engineering*, Vol. 61, pages 62–66, (1989), "Redox Cationic Polymerization: The Diaryliodonium Salt/Ascorbate Redox Couple," by J. V. Crivello and J. H. W. Lam in *Journal of Polymer Science: Polymer Chemistry Edition*, Vol. 19, pages 539–548 (1981), "Redox-Induced Cationic Polymerization: The Diaryliodonium Salt/Benzoin Redox Couple," by J. V. Crivello and J. L. Lee in *Journal of Polymer Science: Polymer Chemistry Edition*, Vol. 21, pages 1097–1110

(1983), "Diaryliodonium Salts as Thermal Initiators of Cationic Polymerization," by J. V. Crivello, T. P. Lockhart and J. L. Lee in *Journal of Polymer Science: Polymer Chemistry Edition*, Vol. 21, pages 97–109 (1983), the disclosures of each of which are totally incorporated herein by reference.

Further examples of suitable initiators include alpha-alkoxy phenyl ketones, O-acylated alpha-oximinoketones, polycyclic quinones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, haloalkanes, alpha-halo alpha-phenylacetophenones, photoreducible dye-reducing agent redox couples, halogenated paraffins such as brominated or chlorinated paraffin, benzoin alkyl esters, cationic diborate anion complexes, anionic di-iodonium ion compounds, and anionic dye-pyrrilium compounds.

Additional examples of suitable initiators are disclosed in, for example, U.S. Pat. Nos. 4,683,317, 4,378,277, 4,279,717, 4,680,368, 4,443,495, 4,751,102, 4,334,970, "Complex Triarylsulfonium Salt Photoinitiators I. The Identification, Characterization, and Syntheses of a New Class of Triarylsulfonium Salt Photoinitiators," J. V. Crivello and J. H. W. Lam, *Journal of Polymer Science: Polymer Chemistry Edition*, Vol. 18, 2677–2695 (1980); "Complex Triarylsulfonium Photoinitiators II. The Preparation of Several New Complex Triarylsulfonium salts and the Influence of Their Structure in Photoinitiated Cationic Polymerization," J. V. Crivello and J. H. W. Lam, *Journal of Polymer Science Polymer Chemsitry Edition*, Vol. 18, pages 2697–2714 (1980); "Diaryliodonium Salts A New Class of Photoinitiators for Cationic Polymerization," J. V. Crivello and J. H. W. Lam, *Maromolecules*, Vol. 10, pages 1307–1315 (1977); and "Developments in the Design and Applications of Novel Thermal and Photochemical Initiators for Cationic Polymerization" by J. V. Crivello, J. L. Lee and D. A. Conlon in *Makromol. Chem. Macromolecular Symposium*, Vol. 13/14, pages 134–160 (1988), the disclosures of each of which are totally incorporated herein by reference. The initiator is present in the curable material in an effective amount, generally from about 0.1 to about 10 percent by weight of the curable material, and preferably from about 0.1 to about 3 percent by weight of the curable material.

When a photoinitiator is selected, photopolymerization can be performed with the aid of an autoxidizer, which is generally a compound capable of consuming oxygen in a free radical chain process. Examples of useful autoxidizers include N,N-dialkylaninines, particularly those substituted in one or more of the ortho, meta, or para positions with groups such as methyl, ethyl, isopropyl, t-butyl, 3,4-tetramethylene, phenyl, trifluoromethyl, acetyl, ethoxycarbonyl, carboxy, carboxylate, trimethylsilylmethyl, trimethylsilyl, triethylsilyl, trimethylgermanyl, triethylgermanyl, trimethylstannyl, triethylstannyl, n-butoxy, n-pentyloxy, phenoxy, hydroxy, acetyl-oxy, methylthio, ethylthio, isopropylthio, thio-(mercapto-), acetylthio, fluoro, chloro, bromo, or iodo. Autoxidizers when present are present in an effective amount, typically from about 0.1 to about 5 percent by weight, of the curable liquid.

A UV sensitizer which could impart electron transfer, and exciplex-induced bond cleavage processes during radiation curing can, if desired, be included in the developers of the present invention. Typical photosensitizers include anthrecene, perylene, phenothiazine, thioxanthone, benzophenone, fluorenone, and the like. The sensitizer is present in any effective amount, typically from about 0.1 to about 5 pecent by weight of the curable material, although the amount can be outside this range.

Developers of the present invention can be prepared by any process suitable for the type of colorant selected. For example, when the toner comprises a vehicle, a polymer and a pigment, the developer can be prepared by mixing the ingredients, followed by grinding the mixture in an attritor in the presence of the selected vehicle at a temperature at or above the melting point of the vehicle. When the developer contains pigment particles and a polymer soluble in the vehicle at elevated temperatures and insoluble at ambient temperatures, the polymer can be dispersed by heating the mixture, grinding the mixture in an attritor at elevated temperatures, and grinding while the mixture cools. Methods of preparing various kinds of liquid developers are disclosed in several of the documents previously incorporated herein by reference, including U.S. Pat. Nos. 4,476,210, 4,794,651, 4,877,698, 4,880,720, 4,880,432, and copending applications U.S. Ser. No. 07/369,003 and U.S. Ser. No. 07/300,395, and these processes can be used to prepare the developers of the present invention by performing them at or above the melting temperature of the vehicle. The charge control agent can be added to the mixture either during mixing of the other ingredients or afterthe developer has been prepared but is still liquid.

The developers employed for the present invention are solid at room temperature. The solid developer can be prepared in any suitable form, such as a powder, pellets, sheets, bars of various sizes, or the like. The form of the solid developer can be chosen to optimize handling ease or to minimize safety concerns. It may be advantageous to provide the developer as a powder so that the powder can be loaded into an imaging apparatus by pouring. A powder is also easy to heat and melt to a liquid. In addition, it may be advantageous to provide the developer in pellet form, since pellets are also easy to pour and nearly as easy to melt as powders, in situations wherein the handling of small particle powders is a concern for reasons of cleanliness or safety. Further, developers provided in bar or sheet form are also easy to handle. Apparatus intended for use with developers provided in bar or sheet form generally will be adapted for loading and heating the relatively large solid material.

Developer delivery systems can also be designed to minimize difficulties such as start-up delays while the solid developer in the sump is melted, clogging of tubing and pumps with the solid developer, or the like. For example, the phase change process itself can be employed as the driver to supply developer in the liquid phase to the development zone. One specific example of such a process is to supply a solid volume of the developer pressed against a heated grate which melts the developer, after which the now liquid developer pours into the heated development zone ready for imaging. When more developer is required, the volume of solid developer is again pressed against the heated grate to repeat the cycle.

The use of a developer which is solid at room temperature and liquid at the development temperature enables enhanced flexibility in the design of the imaging apparatus, particularly with respect to the location of the process elements around the imaging member. In traditional liquid development processes, the developer stations are generally required to be situated below the imaging member. With the processes of the present invention, the developer stations need not be situated on the bottom of the imaging member, since the developer in solid form does not flow. Accordingly, the processes of the present invention enable more effective use of space around the imaging member and thus enable design of a more compact system.

In general, images are developed with the electrophoretic developers and the polarizable developers of the present invention by generating an electrostatic latent image and contacting the latent image with the developer while the developer is maintained at or above its melting point, thereby causing the image to be developed. When an electrophoretic developer of the present invention is employed, the process entails generating an electrostatic latent image and contacting the latent image with the developer while maintaining the developer at or above its melting point, thereby causing the charged particles to migrate through the liquid vehicle and develop the image. Developers and processes of this type are disclosed in, for example, U.S. Pat. Nos. 4,804,601, 4,476,210, 2,877,133, 2,890,174, 2,899,335, 2,892,709, 2,913,353, 3,729,419, 3,841,893, 3,968,044, 4,794,651, 4,762,764, 4,830,945, 3,976,808, 4,877,698, 4,880,720, 4,880,432, and copending application U.S. Ser. No. 07/300,395, the disclosures of each of which are totally incorporated herein by reference, with the exception that the disclosed materials and processes are directed to liquid developers with vehicles that are liquid at room temperature. These processes can be used with the developers of the present invention by maintaining the bath containing the developer, the developer delivery system to the development zone, and the development zone at a temperature at or above the melting point of the developer. If the developed image is transferred from the imaging member to an intermediate transfer member and from the transfer member to a final substrate, it is preferred that the intermediate also be maintained at a temperature at or above the melting point of the developer.

When a developer of the present invention suitable for polarizable liquid development processes is employed, the process entails generating an electrostatic latent image on an imaging member, applying the developer in liquid form at a temperature at or above its melting point to an applicator, and bringing the applicator into sufficient proximity with the latent image to cause the image to attract the developer onto the imaging member, thereby developing the image. Developers and processes of this type are disclosed in, for example, U.S. Pat. Nos. 4,047,943, 4,059,444, 4,822,710, 4,804,601, 4,766,049, 4,686,936, 4,764,446, Canadian Patent 937,823, Canadian Patent 926,182, Canadian Patent 942,554, British Patent 1,321,286, and British Patent 1,312,844, the disclosures of each of which are totally incorporated herein by reference, with the exception that the disclosed materials and processes are directed to liquid developers with vehicles that are liquid at room temperature. These processes can be used with the developers of the present invention by maintaining the bath containing the developer, the developer delivery system to the development zone, and the development zone at a temperature at or above the melting point of the developer. If the developed image is transferred from the imaging member to an intermediate transfer member and from the transfer member to a final substrate, it is preferred that the intermediate also be maintained at a temperature at or above the melting point of the developer. In both of these embodiments, any suitable means can be employed to generate the image. For example, a photosensitive imaging member can be exposed by incident light or by laser to generate a latent image on the member, followed by development of the image and transfer to a substrate such as paper, transparency material, cloth, or the like. In addition, an image can be generated on a dielectric imaging member by electrographic or ionographic processes as disclosed, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, 4,485,982, 4,731,622, 3,701,464, and 4,155,093, the disclosures of each of which are totally incorporated herein by reference, followed by development of the image and, if desired, transfer to a substrate.

The photoelectrophoretic developers of the present invention can be employed in photoelectrophoretic development processes, which generally entail placing a suspension of electrically photosensitive particles in a fluid between two electrodes, at least one of which is generally a substantially transparent plate. Exposure of the suspension to a light image while a field is applied between the electrodes causes the formation of an image by deposition of the suspended particles in imagewise configuration on the electrode. In one embodiment, as disclosed, for example, in U.S. Pat. No. 4,043,655, both electrodes are transparent plates. In another embodiment, as disclosed, for example, in U.S. Pat. No. 4,023,968, one electrode is a transparent conductive support and the other is a generally cylindrically shaped biased electrode that is rolled across the first electrode upon which has been placed the suspension of photosensitive particles. Multicolor images can be made by, among other methods, employing a developer containing photosensitive particles of all desired colors and sequentially exposing the suspension to light images through color filters. Photoelectrophoretic processes are described in detail in, for example, U.S. Pat. Nos. 4,043,655, 4,023,968, 4,066,452, 3,383,993, 3,384,566, 3,384,565, and 3,384,488, the disclosures of each of which are totally incorporated herein by reference. Photoelectrophoretic liquid development can be carried out with any of these processes with photoelectrophoretic developers of the present invention, with the exception that the disclosed materials and processes are directed to liquid developers with vehicles that are liquid at room temperature. These processes can be used with the developers of the present invention by maintaining the bath containing the developer, the developer delivery system to the development zone, and the development zone at a temperature at or above the melting point of the developer. If the developed image is transferred from the imaging member to an intermediate transfer member and from the transfer member to a final substrate, it is preferred that the intermediate also be maintained at a temperature at or above the melting point of the developer.

In the embodiments of the present invention wherein colored particles migrate through the developer vehicle to deposit selectively on a charge pattern image, the concentration of particles in the developer diminishes with each successive imaging cycle. The temperature in the development zone can be adjusted to extend the useful lifetime of a given supply of developer in these embodiments. The developer is supplied in solid form, such as a bar, and is inserted into the development station. The solid melts and is used until the concentration of colored particles is decreased to a degree wherein imaging is no longer effective. Preferred effective particle concentrations generally are no lower than about 0.5 percent by weight, and typically are from about 0.5 percent by weight to about 3 percent by weight, although the particle concentration can be outside these ranges. The temperature in the development zone is adjusted over the lifetime of the developer to decrease the developer viscosity as the particle concentration decreases, thereby enabling the most efficient use of developer having a relatively low concentration of colored particles. Thereafter, unusable waste developer can be drained into a cold mold which causes the waste to harden into a convenient shape for disposal, and a new solid supply of developer is added to the imaging apparatus to continue imaging.

Transfer of a developed image from the imaging member to an intermediate transfer element or a final substrate, or from an intermediate transfer element to another intermediate transfer element or a final substrate, can be enhanced, if desired, by the application of a heat gradient between the surface on which the image rests and the surface to which the image is to be transferred. For example, the developed image can be cooled on the imaging member to solidify it and to reduce its adhesion to the imaging member. The transfer element or final substrate can be heated so that the top surface of the image is at a higher temperature than the areas of the image directly in contact with the surface on which the image rests. Treating the image in this manner softens or liquefies the top surface of the image, thereby rendering it tacky or sticky and easy to transfer to the new surface, while the area of the image in contact with the old surface remains solid and thus flakes away easily from the surface from which the image is to be transferred.

Alternatively, an intermediate transfer element or final substrate can be cooled below the melting point of the developer so that when this element or substrate contacts the liquid image, the part of the image that contacts the element or substrate solidifies, and the resulting increase in adhesion aids in the transfer of the image. The preferred embodiment depends on the surface elements of the transfer element, final substrate, imaging member, and developed image.

If necessary, transferred images can be fused to the substrate by any suitable means, such as by heat, pressure, exposure to solvent vapor or to sensitizing radiation such as ultraviolet light or the like as well as combinations thereof. Further, the developers of the present invention can be employed to develop electrographic images wherein an electrostatic image is generated directly onto a substrate by electrographic or ionographic processes and then developed, with no subsequent transfer of the developed image to an additional substrate.

Preferably, the amount of vehicle applied to the final substrate is minimized. When the image is developed on an imaging member and then transferred to a final substrate, means of reducing the amount of vehicle transferred to the final substrate include the use of one or more intermediate transfer members to which the image is first transferred and from which the image is then transferred to the substrate, the use of metering devices or blotters or the like to remove excess vehicle in the liquid state, or the like.

If desired, subsequent to transfer of the developed image from the imaging member to an intermediate transfer element or to the final substrate, the imaging member can be cleaned to remove any remaining developer material. Cleaning can take place in any desired manner. For example, the imaging member surface can be heated to liquefy the developer, followed by blotting the liquid from the imaging member surface. In addition, when the imaging member is in the form of a flexible belt, the remaining developer on the imaging member surface can be cooled, followed by passing the imaging member around a very sharp turn, thereby causing excess developer to flake away from the imaging member surface. Further, the the remaining developer on the imaging member surface can be cooled, followed by breaking up the solid remaining developer by any suitable method, such as an air knife, ultrasonics, vibrations, mechanical means, or the like, followed by removal of the developer by any suitable means, such as application of a vacuum.

Subsequent to application of the developed image to the final substrate, either directly or via one or more transfer steps, an optional fusing process can be implemented if desired. In some situations it may be desirable to remove excess hydrocarbon vehicle from the substrate; excess solid vehicle material may cause an objectionable appearance or texture, and it is also possible that the presence of excess solid vehicle material may weaken the integrity of the fused image. Accordingly, the image on the substrate may be subjected to treatment by a high pressure roll which has the effect of forcing excess vehicle material into the substrate, particularly when the substrate is porous, such as paper. For example, the substrate may be passed through a high pressure nip during transfer of the image from the imaging member or from an intermediate transfer member to the substrate. Alternatively, the substrate bearing the image may be passed through a high pressure nip subsequent to any image transfer steps. Typical pressures in the pressure nip in this embodiment are from about 100 to about 10,000 pounds per square inch, although the pressure can be outside this range. If desired, the pressure roll can be heated to a temperature sufficient to soften or even to melt the vehicle material, thereby improving the degree of penetration of the vehicle into the substrate material.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A cyan developer of the present invention was prepared as follows. To a Union Process Attritor (available from Union Process Inc., Akron, Ohio) was added 88.0 parts by weight of NUCREL® 599 (an ethylene-methacrylic acid copolymer, available from E. I. Du Pont de Nemours & Co., Wilmington, Del.), 10.0 parts by weight of Heliogen NBD 7010 (a cyan copper phthalocyanine pigment containing pigment blue 15.3, available from BASF Corp., Chemical Division, Cherry Hill, N.J.), 2.0 parts by weight aluminum stearate (available from Witco Chemical Co., New York, N.Y.), and ISOPAR® L (an isoparaffinic hydrocarbon with a boiling point of 194° C., available from Exxon Chemical Co., Houston, Tex.), in an amount so that the solids content in the attritor was 26.7 percent. The total solids content (everything other than ISOPAR® L) in the attritor was 120 pounds. The attritor contents were ground at 80° C. and at about 100 revolutions per minute for a period of 1 hour, followed by cooling the attritor contents to ambient temperature (about 25° C.). Thereafter, additional ISOPAR® L (in an amount so that the total solids content in the attritor was 20 percent) was added to the attritor contents and the contents were ground for an additional two hours at ambient temperature and at 100 revolutions per minute, after which the toner particle size was less than about 2 microns. Thereafter, 2.5 parts by weight of Nuxtra LTD (bismuth and calcium 2-ethylhexoates in mineral spirits, 18% metal, available from Huls America, Piscataway, N.J.), 2.5 milligrams per gram of solids of Basic Barium Petronate (an alkaline petroleum sulfonate in oil, available from Witco Chemical Co., New York, N.Y.), and additional ISOPAR® L (in an amount so that the total solids content in the attritor was 15 percent) was added to the attritor contents and the contents were ground for an additional six hours at 30° C. and at 100 revolutions per minute. Subsequently, additional ISOPAR® L was added to the attritor contents to render a solution having 10 percent by weight solids content. Thereafter, 200 grams of the 10 percent solids solution was added to 780 grams of molten n-octadecane ($C_{18}H_{38}$, 99%, available from Eastman Kodak Co., Rochester, N.Y.). To this mixture was added 20 grams of a solution containing 10 percent by weight of Basic Barium Petronate in ISOPAR® L. Upon cooling the mixture to room temperature, 1000 grams of a hard solid was formed.

EXAMPLE II

A yellow developer of the present invention was prepared as follows. To a Union Process Attritor (available from Union Process Inc., Akron, Ohio) was added 87.0 parts by weight of NUCREL® 599 (an ethylene-methacrylic acid copolymer, available from E. I. Du Pont de Nemours & Co., Wilmington, Del.), 12.0 parts by weight of Diarylide Yellow (AAMX) 275–0536 (a yellow pigment containing Pigment Yellow 13, available from Sun Chemical Co., Cincinatti, Ohio), 1.0 part by weight aluminum stearate (available from Witco Chemical Co., New York, N.Y.), and ISOPAR® L (an isoparaffinic hydrocarbon with a boiling point of 194° C., available from Exxon Chemical Co., Houston, Tex.), in an amount so that the solids content in the attritor was 29.6 percent. The total solids content (everything other than ISOPAR® L) in the attritor was 120 pounds. The attritor contents were ground at 90° C. and at about 100 revolutions per minute for a period of 0.5 hour, followed by cooling the attritor contents to ambient temperature (about 25° C.). Thereafter, additional ISOPAR® L (in an amount so that the total solids content in the attritor was 25 percent) was added to the attritor contents and the contents were ground for an additional two hours at ambient temperature and at 100 revolutions per minute, after which the toner particle size was less than about 2 microns. Thereafter, 1.25 parts by weight of Nuxtra LTD (bismuth and calcium 2-ethylhexoates in mineral spirits, 18% metal, available from Huls America, Piscataway, N.J.), 2.5 milligrams per gram of solids of Basic Barium Petronate (an alkaline petroleum sulfonate in oil, available from Witco Chemical Co., New York, N.Y.), and additional ISOPAR® L (in an amount so that the total solids content in the attritor was 15 percent) was added to the attritor contents and the contents were ground for an additional two hours at 30° C. and at 100 revolutions per minute. Subsequently, additional ISOPAR® L was added to the attritor contents to render a solution having 10 percent by weight solids content. Thereafter, 200 grams of the 10 percent solids solution was added to 780 grams of molten n-octadecane ($C_{18}H_{38}$, 99%, available from Eastman Kodak Co., Rochester, N.Y.). To this mixture was added 20 grams of a solution containing 10 percent by weight of Basic Barium Petronate in ISOPAR® L. Upon cooling the mixture to room temperature, 1000 grams of a hard solid was formed.

EXAMPLE III

A magenta developer of the present invention was prepared as follows. To a Union Process Attritor (available from Union Process Inc., Akron, Ohio) was added 55.5 parts by weight of NUCREL® 599 (an ethylene-methacrylic acid copolymer, available from E. I. Du Pont de Nemours & Co., Wilmington, Del.), 18.5 parts by weight of Pliotone 3002 (a vinyltoluene-butadiene copolymer, available from Goodyear Tire and Rubber Co., Akron, Ohio), 8.8 parts by weight of Quindo Red R-6713 (a red quinacridone pigment, available from Mobay Chemical Corp., Union, N.J.), 16.3 parts by weight of Quindo Red R-6700 (a violet quinacridone pigment containing Cl pigment violet 19, available from Mobay Chemical Corp., Union, N.J.), 1.0 part by weight aluminum stearate (available from Witco Chemical Co., New York, N.Y.), and ISOPAR® L (an isoparaffinic hydrocarbon with a boiling point of 194° C., available from Exxon Chemical Co., Houston, Tex.), in an amount so that the solids content in the attritor was 22.9 percent. The total solids content (everything other than ISOPAR® L) in the attritor was 96 pounds. The attritor contents were ground at 100° C. and at about 100 revolutions per minute for a period of 1 hour, followed by cooling the attritor contents to ambient temperature (about 25° C.). Thereafter, additional ISOPAR® L (in an amount so that the total solids content in the attritor was 16 percent) was added to the attritor contents and the contents were ground for an additional two hours at ambient temperature and at 100 revolutions per minute, after which the toner particle size was less than about 2 microns. Thereafter, 1.25 parts by weight of Nuxtra LTD (bismuth and calcium 2-ethylhexoates in mineral spirits, 18% metal, available from Huls America, Piscataway, N.J.), 12.0 milligrams per gram of solids of Basic Barium Petronate (an alkaline petroleum sulfonate in oil, available from Witco Chemical Co., New York, N.Y.), and additional ISOPAR® L (in an amount so that the total solids content in the attritor was 13.5 percent) was added to the attritor contents and the contents were ground for an additional six hours at 30° C. and at 100 revolutions per minute. Subsequently, additional ISOPAR® L was added to the attritor contents to render a solution having 10 percent by weight solids content. Thereafter, 200 grams of the 10 percent solids solution was added to 780 grams of molten n-octadecane ($C_{18}H_{38}$, 99%, available from Eastman Kodak Co., Rochester, N.Y.). To this mixture was added 20 grams of a solution containing 10 percent by weight of Basic Barium Petronate in ISOPAR® L. Upon cooling the mixture to room temperature, 1000 grams of a hard solid was formed.

EXAMPLE IV

A black developer of the present invention was prepared as follows. To a Union Process Attritor (available from Union Process Inc., Akron, Ohio) was added 80.0 parts by weight of NUCREL® 599 (an ethylene-methacrylic acid copolymer, available from E. I. Du Pont de Nemours & Co., Wilmington, Del.), 18.6 parts by weight of Sterling NS (a black pigment containing carbon black, available from Cabot Corp., Boston, Mass.), 0.4 part by weight of Heliogen NBD 7010 (a cyan copper phthalocyanine pigment containing pigment blue 15.3, available from BASF Corp., Chemical Division, Cherry Hill, N.J.), 1.0 part by weight aluminum stearate (available from Witco Chemical Co., New York, N.Y.), and ISOPAR® L (an isoparaffinic hydrocarbon with a boiling point of 194° C., available from Exxon Chemical Co., Houston, Tex.), in an amount so that the solids content in the attritor was 27.0 percent. The total solids content (everything other than ISOPAR® L) in the attritor was 120 pounds. The attritor contents were ground at 80° C. and at about 100 revolutions per minute fora period of 1 hour, followed by cooling the attritor contents to ambient temperature (about 25° C.). Thereafter, additional ISOPAR® L (in an amount so that the total solids content in the attritor was 17.5 percent) was added to the attritor contents and the contents were ground for an additional two hours at ambient temperature and at 100 revolutions per minute, after which the toner particle size was less than about 2 microns. Thereafter, 1.25 parts by weight of Nuxtra LTD (bismuth and calcium 2-ethylhexoates in mineral spirits, 18% metal, available from Huls America, Piscataway, N.J.), 1.0 milligrams per gram of solids of Basic Barium Petronate (an alkaline petroleum sulfonate in oil, available from Witco Chemical Co., New York, N.Y.), and additional ISOPAR® L (in an amount so that the total solids content in the attritor was 15 percent) was added to the attritor contents and the contents were ground for an additional six hours at 30° C. and at 100 revolutions per minute. Subsequently, additional ISOPAR® L was added to the attritor contents to render a solution having 10 percent by weight solids content. Thereafter, 200 grams of the 10 percent solids solution was added to 780 grams of molten n-octadecane ($C_{18}H_{38}$, 99%, available from Eastman Kodak Co., Rochester, N.Y.). To this mixture was added 20 grams of a solution containing 10 percent by weight of Basic Barium Petronate in ISOPAR® L. Upon cooling the mixture to room temperature, 1000 grams of a hard solid was formed.

EXAMPLE V

Images with each of the developers prepared in Examples I through IV were formed as follows. A Xerox® 6800 laser image processor was refitted with a liquid development system equipped to handle four separate single color developers. The developers were each heated to 37° C., which caused a phase change from solid to liquid. Each developer was subjected to constant circulation. The selenium alloy photoreceptor was exposed by a laser forming a latent image which was then developed in the first developer housing. The developer housings each contained a development electrode spaced 200 microns from the photoreceptor and biased to −50 volts. Excess hydrocarbon was then metered away from the developed image by a reverse roll which was gapped 50 microns from the photoreceptor and biased to 300 volts. The image was then electrostatically transferred to a paper substrate (Hammermill Laser, available from Hammermill, Memphis, Tenn.). The imaging and development steps were repeated using the second, third, and fourth developer housings to build a four-color image on the paper. The image was then fused by convection heating to yield a good quality four color print with clean background and sharp colors.

EXAMPLE VI

A magenta developer of the present invention was prepared as follows. To a Union Process Attritor (available from Union Process Inc., Akron, Ohio) was added 55.5 parts by weight of NUCREL® 599 (an ethylene-methacrylic acid copolymer, available from E. I. Du Pont de Nemours & Co., Wilmington, Del.), 18.5 parts by weight of Pliotone 3002 (a vinyltoluene-butadiene copolymer, available from Goodyear Tire and Rubber Co., Akron, Ohio), 8.8 parts by weight of Quindo Red R-6713 (a red quinacridone pigment, available from Mobay Chemical Corp., Union, N.J.), 16.3 parts by weight of Quindo Red R-6700 (a violet quinacridone pigment containing Cl pigment violet 19, available from Mobay Chemical Corp., Union, N.J.), 1.0 part by weight aluminum stearate (available from Witco Chemical Co., New York, N.Y.), and ISOPAR® L (an isoparaffinic hydrocarbon with a boiling point of 194° C., available from Exxon Chemical Co., Houston, Tex.), in an amount so that the solids content in the attritor was 22.9 percent. The total solids content (everything other than ISOPAR® L) in the attritor was 96 pounds. The attritor contents were ground at 100° C. and at about 100 revolutions per minute for a period of 1 hour, followed by cooling the attritor contents to ambient temperature (about 25° C.). Thereafter, additional ISOPAR® L (in an amount so that the total solids content in the attritor was 16 percent) was added to the attritor contents and the contents were ground for an additional two hours at ambient temperature and at 100 revolutions per minute, after which the toner particle size was less than about 2 microns. Thereafter, 1.25 parts by weight of Nuxtra LTD (bismuth and calcium 2-ethylhexoates in mineral spirits, 18% metal, available from Huls America, Piscataway, N.J.), 12.0 milligrams per gram of solids of Basic Barium Petronate (an alkaline petroleum sulfonate in oil, available from Witco Chemical Co., New York, N.Y.), and additional ISOPAR® L (in an amount so that the total solids content in the attritor was 13.5 percent) was added to the attritor contents and the contents were ground for an additional six hours at 30° C. and at 100 revolutions per minute. Subsequently, additional ISOPAR L was added to the attritor contents to render a solution having 10 percent by weight solids content. Thereafter, 62.5 grams of the 10 percent solids solution was added to 937.5 grams of molten (42.9° C.) n-eicosane ($C_{20}H_{42}$, 99%, available from Eastman Kodak Co., Rochester, N.Y.). To this mixture was added 10 grams of a solution containing 10 percent by weight of Basic Barium Petronate in ISOPAR L. Upon cooling the mixture to room temperature, a hard solid was formed.

The solid magenta toner thus prepared was liquified by heating to 40° C. in the imaging apparatus described in Example V except that the developer electrode gap was 0.010 inches and the metering roll was gapped from the photoreceptor at 0.002 microns and biased to 175 volts. A single color magenta print was generated by the process described in Example V to yield a magenta print. This print exhibited some background development but clearly demonstrated the viability of printing under the conditions specified.

EXAMPLE VII

A curable liquid suitable for use in the process of the present invention as a polarizable liquid developer is prepared as follows. A solution comprising 30 percent by weight of styrene-butylmethacrylate copolymer (containing 50 mole percent styrene, 50 mole percent butylmethacrylate, with a molecular weight of about 50,000) in butanediol divinyl ether (Rapi-Cure BDVE, available from GAF, Linden, N.J.) is prepared by mixing together the ingredients. Subsequently, to 10 parts by weight of this solution heated to about 35° C. is added 90 parts by weight of octadecyl vinylether, also heated to about 35° C. (available from GAF, Linden, N.J.). Thereafter, 0.20 parts by weight of a di(isobutylphenyl)iodonium hexafluoroarsenate polymerization initiator (prepared as described by Crivello and Lam in *Macromolecules*, 10(6) 1307 (1977), the disclosure of which is totally incorporated herein by reference) is mixed with 4.54 parts by weight of octadecyl vinylether heated to about 35° C. and 4.54 parts by weight of butanediol divinylether heated to about 35° C. to form an initiator dispersion. Subsequently, 90 parts of the solution containing the copolymer are mixed with 10 parts by weight of the initiator dispersion to form the curable liquid. The hot mix is left to cool to form the solid form of the curable polarizable liquid developer.

An electrostatic image is generated by exposure of a print test pattern to the photoreceptor in a Xerox®/Cheshire® Dl 785 label maker, which employs a polarizable liquid development process. The polarizable liquid developer is heated to about 35° C. and the development zone is maintained at approximately this temperature with a hot air heater. The liquid image on the photoreceptor is transferred to a heated paper substrate by contacting the paper to the photoreceptor. The image is then fixed to the paper by passing the paper bearing the image through a Hanovia UV-6 cure station (Hanovia, Newark, N.J.) with the ultraviolet lamp set to 300 watts and the conveyor running at 20 feet per minute. It is believed that the resulting image will be of high quality and high resolution.

EXAMPLE VIII

A radiation curable cyan developer of the present invention is prepared as described in Example I except that octadecyl divinylether (available from GAF, Linden, N.J.) is substituted for the n-octadecane. An image is developed and transferred to paper with this developer as described in Example V. The paper is kept warm at about 35° C. so that the image remains molten. The image on the paper is then cured by (1) making a 0.67 percent by weight solution of bis(tert-butylphenyl) iodonium hexafluoroarsenate (as described in Example VII) in a 2 to 1 mixture (by volume) of decyl vinylether (Decave, available from International Flavors & Fragrances, Inc., New York, N.Y.) and 1,4, -bis[(vinyloxy)methyl)]-cyclohexane (Rapi-Cure CHVE, available from GAF Corporation, Wayne, N.J.) and heating the solution to 90° C. for 15 minutes; (2) spraying this initiator solution over the image on the paper with a Crown Spra-tool (available from Crown Industrial Products Company, Hebron, Ill.); and (3) passing the sprayed image through a Hanovia UV-6 cure station as described in Example VII. It is believed that the resulting image will be of high quality and high resolution.

EXAMPLE IX

A developer for use in the process of the present invention as a polarizable liquid developer is prepared as described in Example VII except that n-octadecane is substituted for the BDVE and the octadecyidivinylether. The electrostatic image is formed and developed as described in Example VII. The image is then fixed by allowing it to cool to room temperature. It is believed that the resulting image will be of high quality and high resolution.

EXAMPLE X

A developer of the present invention suitable for use in a photoelectrophoretic imaging process is prepared by adding about 7 parts by weight of Locarno Red X-1686, 1-(4'-methyl-5'-chloroazobenzene-2'-sulfonic acid)-2-hydroxy-3-napthoic acid, C.I. No. 15865, available from American Cyanamide, to about 93 parts by weight of molten (about 45° C.) n-eicosane ($C_{20}H_{42}$, 99%, available from Eastman Kodak Co., Rochester, N.Y.) and grinding the resulting mixture in a heated ball mill for about 48 hours to reduce the particle size to an average diameter of less than about 1 micron. A photoelectrophoretic imaging apparatus of the general type schematically illustrated in FIG. 1*a* of U.S. Pat. No. 3,384,488, the disclosure of which is totally incorporated herein by reference, is used to test the developer with the developer coated on the NESA glass substrate through which the exposure is made. The development zone is kept above the melting point of the developer, about 45° C. The NESA glass surface is connected in series with a switch, a potential source, and the conductive center of a roller having a coating of baryta paper on its surface. The roller is approximately 2.5 inches in diameter and is moved across the plate surface at about 1.5 centimeters per second. The plate employed is roughly 3 inches square and exposed with a light intensity of about 1800 foot-candles. During imaging, a positive potential of about 2,500 volts is imposed on the core of the roller. The gap between the baryta paper surface and the NESA glass surface is about 1 mil. Exposure is made with a 3200° K. lamp through a 0.30 neutral density step wedge filter to measure the sensitivity of the suspension to white light, and then Wratton filters 29, 61, 47*b* are individually superimposed over the light source in separate runs to determine the sensitivity of the developer to red, green, and blue light, respectively. The molten images are then allowed to cool to room temperature to form a permanent image. It is believed that the resulting images will be of high quality and high resolution.

EXAMPLE XI

A radiation curable developer of the present invention suitable for use in a photoelectrophoretic development process is prepared as described in Example X except that a one-to-one mixture by weight of octadecyl vinylether (available from GAF, Linden, N.J.) and 1,4, -bis[(vinyloxy) methyl)]-cyclohexane (Rapi-Cure CHVE available from GAF Corp., Wayne, N.J.) are used in place of the eicosane. This developer is tested as described in Example X. The molten images on the baryta paper are overcoated with initiator solution and exposed to the UV light as described in Example VIII to form the permanent image. It is believed that the resulting image will be of high quality and high resolution.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development, wherein excess developer is removed from the developed image subsequent to development, said removal occurring at a temperature above the melting point of the developer, wherein subsequent to development of the image on an imaging member, the developed image is transferred to a substrate, wherein subsequent to transfer, developer material remaining on the imaging member is removed from the imaging member, said removal occurring at a temperature below the melting point of the developer, wherein the imaging member is a flexible belt and developer material remaining on the imaging member is, removed from the imaging member at a temperature below the melting point of the developer by passing the imaging member around a turn sufficiently sharp to enable the developer material to flake away from the imaging member.

2. A process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development, wherein excess developer is removed from the developed image subsequent to development, said removal occurring at a temperature above the melting point of the developer, wherein the vehicle includes a curable material.

3. A process according to claim 2 wherein the curable material is present in an amount of from about 10 to about 100 percent by weight of the vehicle.

4. A process according to claim 2 wherein the curable material is selected from the group consisting of (a) acrylate monomers and polymers containing acrylic groups in which the acrylate or acrylic groups are attached to aliphatic groups having more than about 16 carbon atoms; (b) acrylate monomers and polymers containing acrylic groups in which the acrylate or acrylic groups are attached to aromatic groups having more than about 16 carbon atoms; (c) acrylate monomers and polymers containing acrylic groups in which the acrylate or acrylic groups are attached to aliphatic siloxane groups having more than about 5 dimethyl siloxane units; (d) acrylate monomers and polymers containing acrylic groups in which the acrylate or acrylic groups are attached to aromatic siloxane groups having more than about 5 dimethyl siloxane units; (e) acrylate monomers and polymers containing acrylic groups in which the acrylate or acrylic groups are attached to two or more members of the group consisting of: (1) aliphatic groups having more than about 16 carbon atoms; (2) aromatic groups having more than about 16 carbon atoms; (3) aliphatic siloxane groups having more than about 5 dimethyl siloxane units; and (4) aromatic siloxane groups having more than about 5 dimethyl siloxane units; (f) acrylate monomers and polymers containing acrylic groups in which the acrylate or acrylic groups are attached to polymer chains; (g) methacrylate monomers and polymers containing methacrylic groups in which the methacrylate or methacrylic groups are attached to aliphatic groups having more than about 16 carbon atoms; (h) methacrylate monomers and polymers containing methacrylic groups in which the methacrylate or methacrylic groups are attached to aromatic groups having more than about 16 carbon atoms; (i) methacrylate monomers and polymers containing methacrylic groups in which the methacrylate or methacrylic groups are attached to aliphatic siloxane groups having more than about 5 dimethyl siloxane units; (j) methacrylate monomers and polymers containing methacrylic groups in which the methacrylate or methacrylic groups are attached to aromatic siloxane groups having more than about 5 dimethyl siloxane units; (k) methacrylate monomers and polymers containing methacrylic groups in which the methacrylate or methacrylic groups are attached to two or more members of the group consisting of: (1) aliphatic groups having more than about 16 carbon atoms; (2) aromatic groups having more than about 16 carbon atoms; (3) aliphatic siloxane groups having more than about 5 dimethyl siloxane units; and (4) aromatic siloxane groups having more than about 5 dimethyl siloxane units; (l) methacrylate monomers and polymers containing methacrylic groups in which the methacrylate or methacrylic groups are attached to polymer chains; (m) epoxy monomers and polymers having one or more epoxy functional groups wherein the epoxy groups are attached to aliphatic groups having more than about 16 carbon atoms; (n) epoxy monomers and polymers having one or more epoxy functional groups wherein the epoxy groups are attached to aromatic groups having more than about 16 carbon atoms; (o) epoxy monomers and polymers having one or more epoxy functional groups wherein the epoxy groups are attached to aliphatic siloxane groups having more than about 5 dimethyl siloxane units; (p) epoxy monomers and polymers having one or more epoxy functional groups wherein the epoxy groups are attached to aromatic siloxane groups having more than about 5 dimethyl siloxane units; (q) epoxy monomers and polymers having one or more epoxy functional groups wherein the epoxy groups are attached to two or more members of the group consisting of: (1) aliphatic groups having more than about 16 carbon atoms; (2) aromatic groups having more than about 16 carbon atoms; (3) aliphatic siloxane groups having more than about 5 dimethyl siloxane units; and (4) aromatic siloxane groups having more than about 5 dimethyl siloxane units; (r) epoxy monomers and polymers having one or more epoxy functional groups wherein the epoxy groups are attached to polymer chains; (s) vinyl ether monomers, oligomers, and polymers containing vinyl ether groups wherein the vinyl ether groups are attached to aliphatic groups having more than about 16 carbon atoms; (t) vinyl ether monomers, oligomers, and polymers containing vinyl ether groups wherein the vinyl ether groups are attached to aromatic groups having more than about 16 carbon atoms; (u) vinyl ether monomers, oligomers, and polymers containing vinyl ether groups wherein the vinyl ether groups are attached to aliphatic siloxane groups having more than about 5 dimethyl siloxane units; (v) vinyl ether monomers, oligomers, and polymers containing vinyl ether groups wherein the vinyl ether groups are attached to aromatic siloxane groups having more than about 5 dimethyl siloxane units; (w) vinyl ether monomers, oligomers, and polymers containing vinyl ether groups wherein the vinyl ether groups are attached to tvvo or more members of the group consisting of: (1) aliphatic groups having more than about 16 carbon atoms; (2) aromatic groups having more than about 16 carbon atoms; (3) aliphatic siloxane groups having more than about 5 dimethyl siloxane units; and (4) aromatic siloxane groups having more than about 5 dimethyl siloxane units; (x) vinyl ether monomers, oligomers, and polymers containing vinyl ether groups wherein the vinyl ether groups are attached to polymer chains; (y) styrene monomers, oligomers, and polymers containing styrenic groups wherein the styrene or styrenic groups are attached to aliphatic groups having more than about 16 carbon atoms; (z) styrene monomers, oligomers, and polymers containing styrenic groups wherein the styrene or styrenic groups are attached to aromatic groups having more than about 16 carbon atoms; (aa) styrene monomers, oligomers, and polymers containing styrenic groups wherein the styrene or styrenic groups are attached to aliphatic siloxane groups having more than about 5 dimethyl siloxane units; (bb) styrene monomers, oligomers, and polymers containing styrenic groups wherein the styrene or styrenic groups are attached to aromatic siloxane groups having more than about 5 dimethyl siloxane units; (cc) styrene monomers, oligomers, and polymers containing styrenic groups wherein the styrene or styrenic groups are attached to two or more members of the group consisting of: (1) aliphatic groups having more than about 16 carbon atoms; (2) aromatic groups having more than about 16 carbon atoms; (3) aliphatic siloxane groups having more than about 5 dimethyl siloxane units; and (4) aromatic siloxane groups having more than about 5 dimethyl siloxane units; (dd) styrene monomers, oligomers, and polymers containing styrenic groups wherein the styrene or styrenic groups are attached to polymer chains; (ee) indene monomers, oligomers, and polymers containing indenic groups wherein the indene or indenic groups are attached to aliphatic groups having more than about 16 carbon atoms; (ff) indene monomers, oligomers, and polymers containing indenic groups wherein the indene or indenic groups are attached to aromatic groups having more than about 16 carbon atoms; (gg) indene monomers, oligomers, and polymers containing indenic groups wherein the indene or indenic groups are attached to aliphatic siloxane groups having more than about 5 dimethyl siloxane units; (hh) indene monomers, oligomers, and polymers containing indenic groups wherein the indene or indenic groups are attached to aromatic siloxane groups having more than about 5 dimethyl siloxane units; (ii) indene monomers, oligomers, and polymers containing indenic groups wherein the indene or indenic groups are attached to two or more members of the group consisting of: (1) aliphatic groups having more than about 16 carbon atoms; (2) aromatic groups having more than about 16 carbon atoms; (3) aliphatic siloxane groups having more than about 5 dimethyl siloxane units; and (4) aromatic siloxane groups having more than about 5 dimethyl siloxane units; (jj) indene monomers, oligomers, and polymers containing indenic groups wherein the indene or indenic groups are attached to polymer chains; (kk) aliphatic $\alpha$-olefins having more than about 20 carbon atoms; and (ll) mixtures thereof.

5. A process according to claim 4 wherein the developer also contains an initiator.

6. A process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development, wherein excess developer is removed from the developed image subsequent to development, said removal occurring at a temperature above the melting point of the developer, wherein the developer is an electrophoretic developer containing a charge control additive wherein the colorant comprises colored particles capable of becoming charged and migrating through the vehicle when the vehicle is in liquid form, said developer having a viscosity of no more than about 20 centipoise and a resistivity of no less than about $5\times10^9$ ohm-cm at the temperature maintained while the developer is in contact with the latent image, wherein the vehicle includes a curable material.

7. A process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development, wherein excess developer is removed from the developed image subsequent to development, said removal occurring at a temperature above the melting point of the developer, wherein an applicator having raised areas and depressed areas is provided, the developer is applied to the depressed areas of the applicator, and the raised portions of the applicator are contacted with the imaging member while the developer is maintained at a temperature at or above its melting point, wherein said developer has a viscosity of from about 25 to about 500 centipoise and a resistivity of from about $10^8$ to about $10^{11}$ ohm-cm at the temperature maintained while the developer is in contact with the latent image, thus causing the image to attract the developer from the depressed portions of the applicator onto the latent image to develop the image, wherein the vehicle includes a curable material.

8. A process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development, wherein excess developer is removed from the developed image subsequent to development, said removal occurring at a temperature above the melting point of the developer, wherein an applicator having raised areas and depressed areas is provided, the developer is applied to the depressed areas of the applicator, and the raised portions of the applicator are contacted with the imaging member while the developer is maintained at a temperature at or above its melting point, wherein said developer has a viscosity of from about 25 to about 500 centipoise and a resistivity of from about $10^8$ to about $10^{11}$ ohm-cm at the temperature maintained while the developer is in contact with the latent image, thus causing the image to attract the developer from the depressed portions of the applicator onto the latent image to develop the image.

9. A process according to claim 8 wherein the vehicle has a melting point of from about 25° C. to about 150° C.

10. A process according to claim 8 wherein the vehicle is selected from the group consisting of aliphatic hydrocarbons.

11. A process according to claim 8 wherein the vehicle is selected from the group consisting of n-octadecane, n-nonadecane, n-eicosane, n-heneicsane, n-docosane, n-tricosane, n-tetracosane, n-pentacosane, hydrocarbon waxes, and mixtures thereof.

12. A process according to claim 8 wherein the vehicle comprises a mixture of at least one material which is solid at about 25° C. and at least one material which is liquid at about 25° C.

13. A process according to claim 12 wherein the material which is solid at about 25° C. is selected from the group consisting of n-octadecane, n-nonadecane, n-eicosane, n-heneicsane, n-docosane, n-tricosane, n-tetracosane, n-pentacosane, saturated hydrocarbons with from about 26 to about 30 carbon atoms, hydrocarbon waxes, and mixtures thereof, and the material which is liquid at about 25° C. is selected from the group consisting of normal paraffinic hydrocarbons, isoparaffinic hydrocarbons, mineral oils, and mixtures thereof.

14. A process according to claim 8 wherein the vehicle comprises a mixture of at least one material which is liquid at about 25° C. and at least one metal soap in an effective concentration so that the mixture is solid below 25° C. and will liquefy at a temperature above 25° C.

15. A process according to claim 14 wherein the material which is liquid at about 25° C. is selected from the group consisting of normal paraffinic hydrocarbons, isoparaffinic hydrocarbons, mineral oils, and mixtures thereof.

16. A process according to claim 8 wherein subsequent to development of the image, the image is transferred to a substrate.

17. A process according to claim 16 wherein the image is affixed to the substrate by the application of pressure.

18. A process according to claim 17 wherein the image is heated as pressure is applied.

19. A process according to claim 17 wherein the image is subjected to pressure of from about 100 to about 10,000 pounds per square inch.

20. A process according to claim 8 wherein the developer has a viscosity of from about 30 to about 300 centipoise at the temperature at which development occurs.

21. A process according to claim 8 wherein the developer has a resistivity of from about $2\times10^9$ to about $10^{10}$ ohm-cm at the temperature at which development occurs.

22. A process for forming images which comprises (a) generating an electrostatic latent image; (b) contacting the latent image with a developer consisting essentially of a colorant, an optional charge control additive, and a substantial amount of a vehicle with a melting point of at least about 25° C., said vehicle consisting essentially of a mixture of a liquid hydrocarbon and a metal soap which is insoluble in the liquid hydrocarbon at a temperature of about 25° C. or less, said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

23. A process according to claim 22 wherein the liquid hydrocarbon is selected from the group consisting of branched chain aliphatic hydrocarbons, normal hydrocarbons, mineral oils, and mixtures thereof.

24. A process according to claim 22 wherein the organic portion of the metal soap is selected from the group consisting of stearic acid, hydroxy-stearic acid, stearin, cottonseed oil acids, oleic acid, palmitic acid, myristic acid, hydrogenated fish oils, carboxylic acids derived from tallow, castor oil, wool grease, rosin, and mixtures thereof.

25. A process according to claim 22 wherein the vehicle contains the metal soap in an amount of at least about 4 percent by weight and the liquid hydrocarbon in an amount of up to about 96 percent by weight.

26. A process according to claim 22 wherein the vehicle contains the metal soap in an amount of from about 4 to about 40 percent by weight and the liquid hydrocarbon in an an amount of from about 60 to about 96 percent by weight.

27. A process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development, wherein an applicator having raised areas and depressed areas is provided, the developer is applied to the depressed areas of the applicator, and the raised portions of the applicator are contacted with the latent image while the developer is maintained at a temperature at or above its melting point, wherein said developer has a viscosity of from about 25 to about 500 centipoise and a resistivity of from about $10^8$ to about $10^{11}$ ohm-cm at the temperature maintained while the developer is in contact with the latent image, thus causing the image to attract the developer from the depressed portions of the applicator onto the latent image to develop the image.

28. A process according to claim 27 wherein the developer has a viscosity of from about 30 to about 300 centipoise at the temperature at which development occurs.

29. A process according to claim 27 wherein the developer has a resistivity of from about $2\times10^9$ to about $10^{10}$ ohm-cm at the temperature at which development occurs.

30. A process for forming images which comprises (a) generating an electrostatic latent image on an imaging member; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development, wherein subsequent to development of the image, the image is transferred to a substrate, wherein the imaging member is a flexible belt and developer material remaining on the imaging member is removed from the imaging member at a temperature below the melting point of the developer by passing the imaging member around a turn sufficiently sharp to enable the developer material to flake away from the imaging member.

* * * * *